US005100123A

United States Patent [19]

Kagiura et al.

[11] Patent Number: 5,100,123

[45] Date of Patent: Mar. 31, 1992

[54] CASSETTE LOADING DEVICE FOR IMAGE FORMING APPARATUS

[75] Inventors: Kazuo Kagiura, Tokyo; Tatsuya Shiratori, Kawasaki; Saijiro Endo, Tokyo; Takahiro Ushiro, Yokohama; Masashi Ohashi, Tokyo, all of Japan

[73] Assignee: Canon Kabushiki Kaisha, Tokyo, Japan

[21] Appl. No.: 423,786

[22] Filed: Oct. 18, 1989

[30] Foreign Application Priority Data

| | | | |
|---|---|---|---|
| Oct. 20, 1988 | [JP] | Japan | 63-265653 |
| Oct. 21, 1988 | [JP] | Japan | 63-266886 |
| Oct. 26, 1988 | [JP] | Japan | 63-271817 |
| Nov. 1, 1988 | [JP] | Japan | 63-277898 |
| Jan. 11, 1989 | [JP] | Japan | 1-005654 |
| Jan. 18, 1989 | [JP] | Japan | 1-009061 |

[51] Int. Cl.[5] ..... B65H 3/06; B65H 1/26

[52] U.S. Cl. ..... 271/164; 271/127

[58] Field of Search ..... 271/162, 164, 127, 162, 271/164

[56] References Cited

U.S. PATENT DOCUMENTS 4,387,889 6/1983 Koyama ..... 271/162 X 4,775,138 10/1988 Muller ..... 271/164 X 4,873,547 10/1989 Sasaki et al. ..... 355/316

*Primary Examiner*—Richard A. Schacher

*Attorney, Agent, or Firm*—Fitzpatrick, Cella, Harper & Scinto

[57] ABSTRACT

The present invention provides a cassette loading device for an image forming apparatus including a sheet feeding portion within which a cassette for accommodating sheets is loaded, and a sheet feeding device arranged in the sheet feeding portion and adapted to feed the sheet from the cassette loaded within the sheet feeding portion. The cassette loading device has a guide for guiding the cassette to be loaded; a cassette shifting device rotatable along the guide means and having pins engageable with the cassette inserted into the sheet feeding portion; a driver for driving the cassette shifting device; vertical surfaces formed in the cassette and against which the pins are abutted to shift the cassette; and horizontal recesses formed in the cassette and adapted to direct the pins toward the vertical surfaces. The present invention further provides an image forming apparatus which includes an image forming apparatus for forming an image on the sheet being fed, and the above-mentioned cassette loading device.

20 Claims, 20 Drawing Sheets

CASSETTE LOADING DEVICE FOR IMAGE FORMING APPARATUS

BACKGROUND OF THE INVENTION

1. Field of the Invention

The present invention relates to a cassette loading device for an image forming apparatus, and more particularly, it relates to an automatic cassette loading device which is arranged in a sheet feeding portion of an image forming apparatus such as a copying machine, printing machine, laser printer and the like which can automatically load or unload a "cassette" accommodating number of sheets with respect to the image forming apparatus. Here, the wording "cassette" is used as a general term for indicating all of sheet accommodating means to be available, and, therefore, in the present invention, the sheet accommodating means is not limited to the so-called removable box-shaped cassette.

2. Related Background Art

In the past, copying machines including removable cassettes therein have been known. Such conventional copying machines are generally grouped into two types: first type is a side loading type wherein the cassette is retracted in a direction opposite to a sheet feeding direction, and second type is a front loading type wherein the cassette is retracted in a direction perpendicular to the sheet feeding direction. In the copying machine of the front loading type, the cassette is slidably supported by guide rails and the like. Recently, the copying machines of the front loading type have been increased for the reasons that (1) less installation space required, (2) the sheet can be replenished without unloading the cassette, (3) the cassette can easily be handled at a front side, and the like.

However, the above-mentioned conventional copying machine of the front loading type, there arose problems that the structure of the machine was complicated and it was difficult and troublesome to position the cassette with respect to the body of the copying machine, since a cassette support, the slidable guide rails and the like were used for slidably supporting and guiding the cassette.

Particularly, in the copying machine of automatic loading type wherein the cassette is automatically loaded and unloaded, there arose problems that the positioning of the cassette was more complicated, that it was difficult to separate the cassette from a driving means, and that it was difficult to change the cassettes.

SUMMARY OF THE INVENTION

An object of the present invention is to provide an image forming apparatus which can solve the above-mentioned conventional problems by permitting or allowing the engagement and disengagement between a sheet accommodating means and a shifting means.

To achieve the above object, the present invention provides an image forming apparatus which is provided with a sheet accommodating means accommodating a number of sheets therein and removably mounted on the apparatus, and which is characterized by that a shifting means for shifting the sheet accommodating means from an insertion position to a sheet feeding position, and an engagement means for detachably connecting the sheet accommodating means to the shifting means.

According to the above characteristic or feature of the present invention, since the sheet accommodating means can be removably connected to the shifting means through the engagement means, the image forming apparatus can be simplified and the positioning of the sheet accommodating means can be easily performed. Further, the loading and unloading of the sheet accommodating means can also be performed easily.

Furthermore, by shifting the sheet accommodating means in accordance with the sheet sizes by means of the shifting means, the time duration for shifting the sheet accommodating means can be properly controlled, thus saving the unnecessary long time for shifting the sheet accommodating means. In addition, when the sheets having the size other than the maximum size are replenished, the sheets can be supplied to the sheet accommodating means at a stable position.

Further, by providing first and second shifting means so that, when the sheet accommodating means is unloaded from the image forming apparatus, the sheet accommodating means is shifted by an electric force through the medium of the first shifting means and then is shifted, by an elastic force through the medium of the second shifting means, to a position where the sheet accommodating means are separated from a detecting means, it is possible to automatically separate the sheet accommodating means from the detecting means automatically, thus being labor-saving for manually separating or disengaging the sheet accommodating means from the detecting means.

Furthermore, by designing so that, when the detecting means detects the increase in load in the driving means, the sheet accommodating means is stopped or reversed to move in an opposite direction, the time necessary to detect the load variation of the driving means can be reduced, thus preventing the damage of the sheet accommodating means and/or image forming apparatus.

Further, by designing so that, when the sheet accommodating means reaches the sheet feeding position, the engagement means (member) is stopped at a downstream side (with respect to the shifting direction of the sheet accommodating means) of an arcuate portion of a belt wrapped around a roller of a belt-roller assembly, the roller can be prevented from being rotated, thus avoiding the aberration in the position where the sheet accommodating means is stopped.

In addition, by designing so that, after the sheet accommodating means is manually removed from the sheet feeding position, the sheet accommodating means can automatically be ejected or returned to the insertion position by the shifting means, a ejection key is not necessarily provided and the sheet accommodating means is prevented from being ejected inadvertently.

DESCRIPTION OF THE PREFERRED EMBODIMENTS

Figure 1:
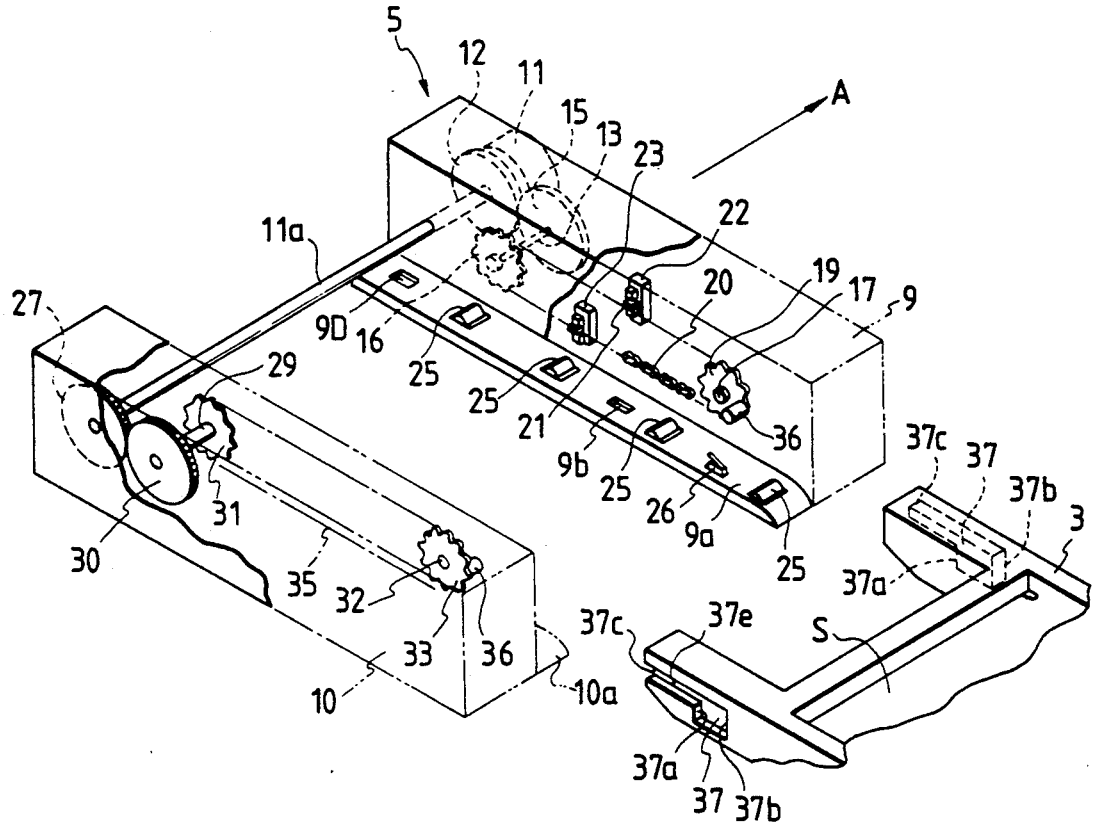
FIG. 1 is a perspective view of a shifting means of a cassette loading device according to the present invention.

The present invention will now be explained in connection with embodiments thereof with reference to the accompanying drawings.

As shown in FIGS. 3 to 6, an image forming apparatus as embodied as a copying machine 1 comprises a shifting device 5 by which a cassette 3 is automatically loaded or unloaded with respect to a machine frame 2, and semi-circular sheet feed rollers 6 supported by a roller shaft 6*a* and adapted to feed a sheet from the cassette 3. The feed rollers 6 are positioned in the vicinity of the shifting device 5. Further, a photosensitive drum 7 supported by a shaft 7*a* is arranged within the machine frame 2, which drum can bear a toner image thereon.

As shown in FIG. 1, the shifting device 5 comprises frames 9 and 10, one of which (i.e., frame 9) includes a reversible motor 11 arranged therein. The motor 11 has a motor shaft 11*a* on which a gear 12 is fixed, which gear 12 is meshed with a gear 15 fixed to a shaft 13 rotatably supported by the frame 9.

On the other end of the shaft 13 a sprocket 16 is fixed, which sprocket is operatively connected, through a chain 20, to a sprocket 19 fixed to a shaft 17 rotatably supported by the frame 9. Further, a shield plate 21 is arranged on links L of the chain 20, which shield plate 21 is adapted to turn ON and OFF (i.e., activate and deactivate) sensors 22 and 23 arranged in the vicinity of the chain 20. The frames 9, 10 have rail portions 9*a*, 10*a*, respectively, on which guide rollers 25 and a cassette detecting sensor 26 are arranged.

The motor shaft 11*a* of the motor 11 extends into the frame 10. On the free end of the shaft 11*a* a gear 27 is fixed. Further, the gear 27 is meshed with a gear 30 fixed to a shaft 29 rotatably supported by the frame 10. On the other end of the shaft 29 a sprocket 31 is fixed, which sprocket is operatively connected, through a chain 35, to a sprocket 33 fixed to a shaft 32 rotatably supported by the frame 10.

The chains 35 and 20 have pins 36 (FIG. 3) which can be moved together with the chains in response to the rotation of the chains 35, 20. Further, the cassette 3 is provided at its both front sides with L-shaped recesses 37 adapted to receive the pins 36 of the chains. Incidentally, in FIG. 3, the reference symbol G designates an original (or manuscript) cover pivotable around a hinge H in a direction B.

Figure 7:
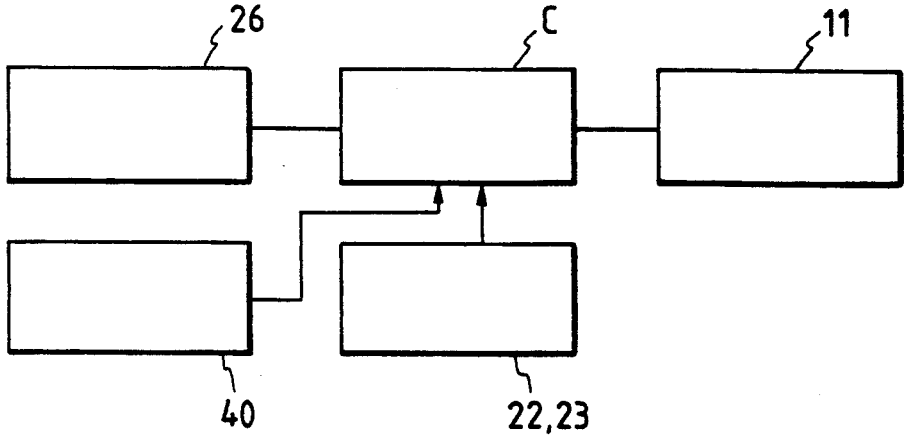
FIG. 7 is a block diagram showing a controlling portion.

As shown in FIG. 7, the copying machine 1 includes a controlling portion C, to an input portion of which the sensors 22, 23, cassette detecting sensor 26 and a cassette taking-out button 40 are connected; whereas the motor 11 is connected to an output portion of the controlling portion C.

In the illustrated embodiment, with the arrangement as mentioned above, when the cassette 3 accommodating the sheets S therein is loaded within the machine frame 2, the pins 36 of the chains are positioned in a position where the pins face to entrance openings 37*c* (FIG. 4) of the corresponding L-shaped recesses 37, i.e., a position where the shield plate 21 is detected by the sensor 22 (refer to FIG. 1). Accordingly, when the cassette 3 is inserted into the machine frame along the rail portions 9*a*, 10*a*, the pins 36 are introduced into the corresponding L-shaped recesses 37. Further, when the bottom surface of the cassette 3 is supported on the outermost roller 25, the pins 36 are aligned with the corresponding entrance openings 37*a* of the L-shaped recesses, and then, when cassette 3 is shifted until straight portions 37*e* of the recesses 37 have passed through the corresponding pins 36, the cassette detecting sensor 26 is turned ON by the bottom surface of the cassette 3.

Consequently, the controlling portion C receives an ON signal from the sensor 26, thereby driving the motor 11. The driving force from the motor 11 is transmitted to the sprocket 16 through the gears 12, 15 and to the sprocket 31 through the motor shaft 11*a* and gears 27, 30. Subsequently, the chain 20 is rotated or turned in a clockwise direction through the rotation of the sprocket 16 and the chain 35 is turned through the rotation of the sprocket 31.

Figure 3:
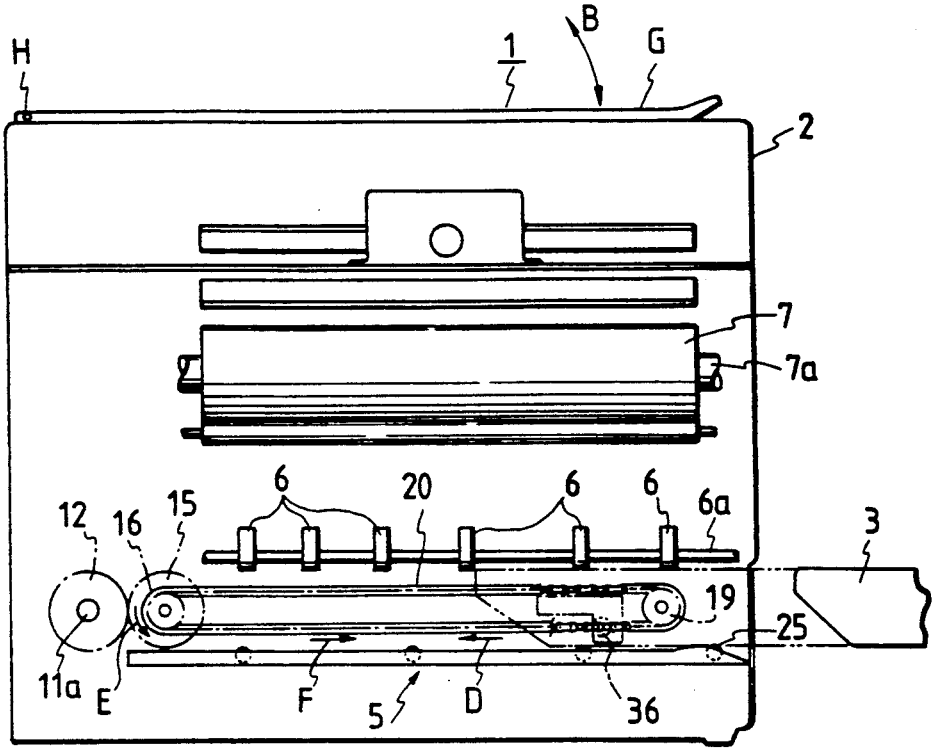
FIG. 3 is a side sectional view of an image forming apparatus according to the present invention.
Figure 4:
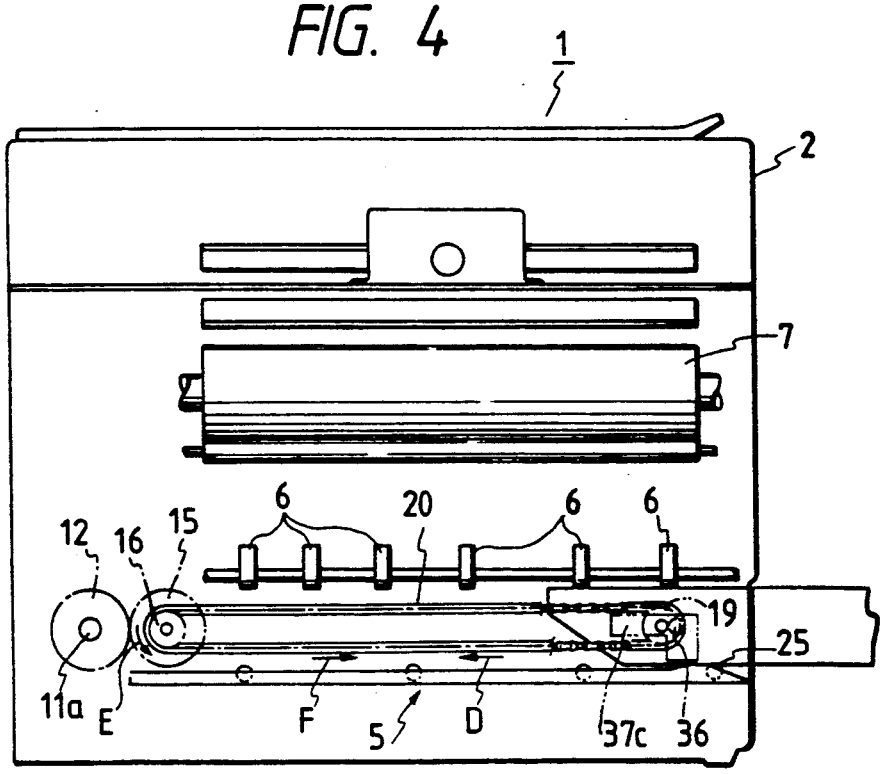
FIGS. 4 and 5 are side sectional views of the image forming apparatus for explaining the operation thereof.
Figure 5:
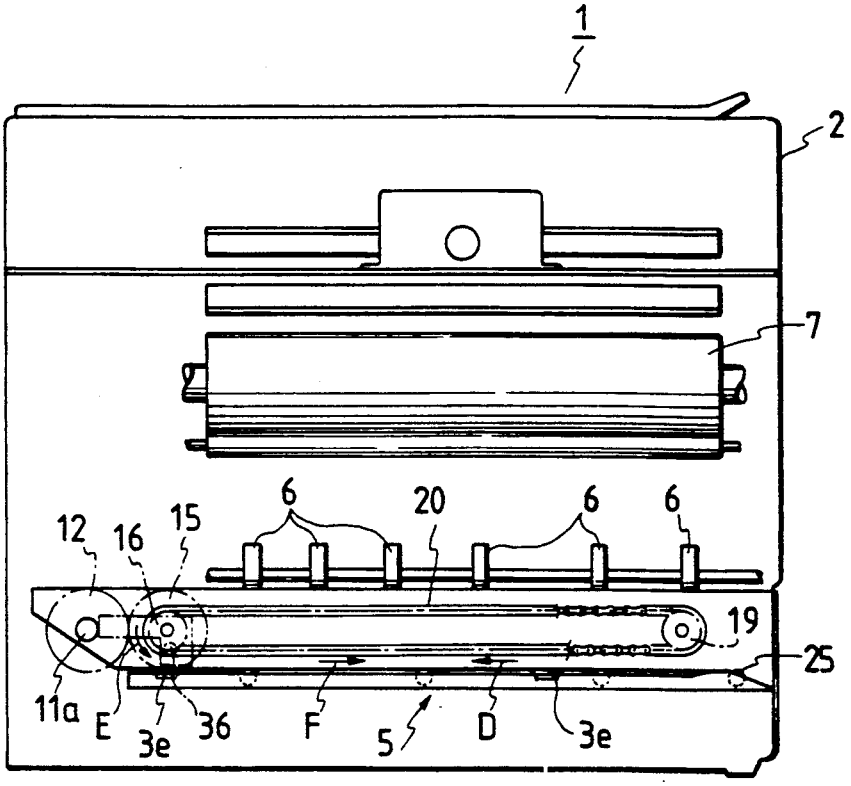
Figure 6:
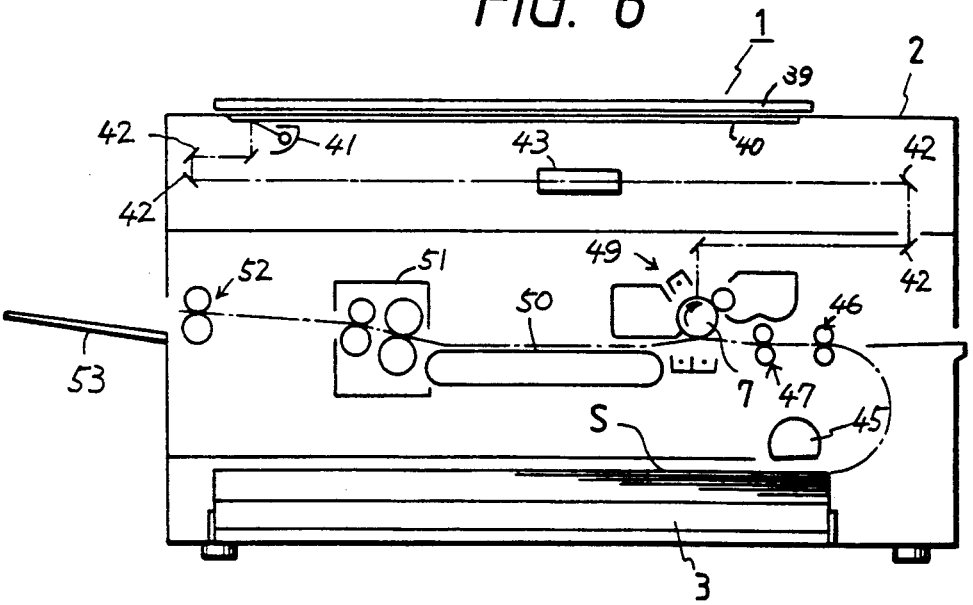
FIG. 6 is an elevational sectional view of the image forming apparatus according to the present invention.

As a result of the rotation of the chain 20, 35, the pins 36 are firstly moved along arcuate paths to abut against corresponding vertical surfaces 37*a* of the L-shaped recesses 37, and, thereafter, the pins 36 are shifted along straight paths in response to further rotation of the chains 20, 35, thus shifting the cassette 3 inwardly of the machine frame (in a direction D) as shown in FIG. 3. Accordingly, the cassette 3 is automatically inserted after it activates the cassette detecting sensor 26. Further, when the cassette 3 is inserted until the shield plate 21 turns the sensor 23 OFF, the controlling portion C receives an OFF signal from the sensor 23, thereby stopping the motor 11. In this point, since the pins 36 of the chains 20, 35 abut against the corresponding vertical surfaces 37*a* of the L-shaped recesses 37 formed in the cassette 3, the latter is positioned in a predetermined position (FIG. 5). Further, in this point, inverted trapezoidal projections 3*e* formed on the bottom surface of the cassette 3 are fitted into corresponding positioning holes formed in the rail portion 9*a*, thus positioning the cassette with respect to a direction perpendicular to the cassette inserting direction. It is more preferable that any braking means or locking means is provided in the motor or the gear train to maintain the cassette in the positioned condition.

On the other hand, when it is desired to unload the cassette 3, the taking-out button 40 is activated or turned ON. Consequently, the braking means or locking means is deactivated or released, and, at the same time, the controlling portion C receives an ON signal from the taking-out button 40, thus rotating the motor 11 in a reverse direction to rotate the sprockets 16, 31 in a direction F (FIG. 5). As a result, the pins 36 of the chains abut against the other vertical surfaces 37*b* (opposed to the above-mentioned vertical surfaces 37*a*) of the L-shaped recesses 37 to return the cassette 3 in the direction F. Thereafter, when the pins 36 is moved upwardly along the arcuate paths, the returning movement of the cassette 3 is stopped.

When the pins 36 are returned to the position where the shield plate 21 deactivates (or turns OFF) the sensor 22, the controlling portion C receives an OFF signal from the sensor 22, thereby deactivating the motor 11 to stop the rotation of the chains 20, 35. In this point, the braking means or locking means may be activated again to maintain the chains in the stopped condition. Further, in this point, since the pins 36 of the chains are positioned in the alignment with the straight portions 37*e* having the entrance openings 37*c* of the L-shaped recesses 37 (see FIG. 4), the cassette 3 can be removed from the machine frame 2 by pulling the cassette rightwardly.

Incidentally, the cassette 3 can be a pawl separating system as well as another type separating system.

Figure 9:
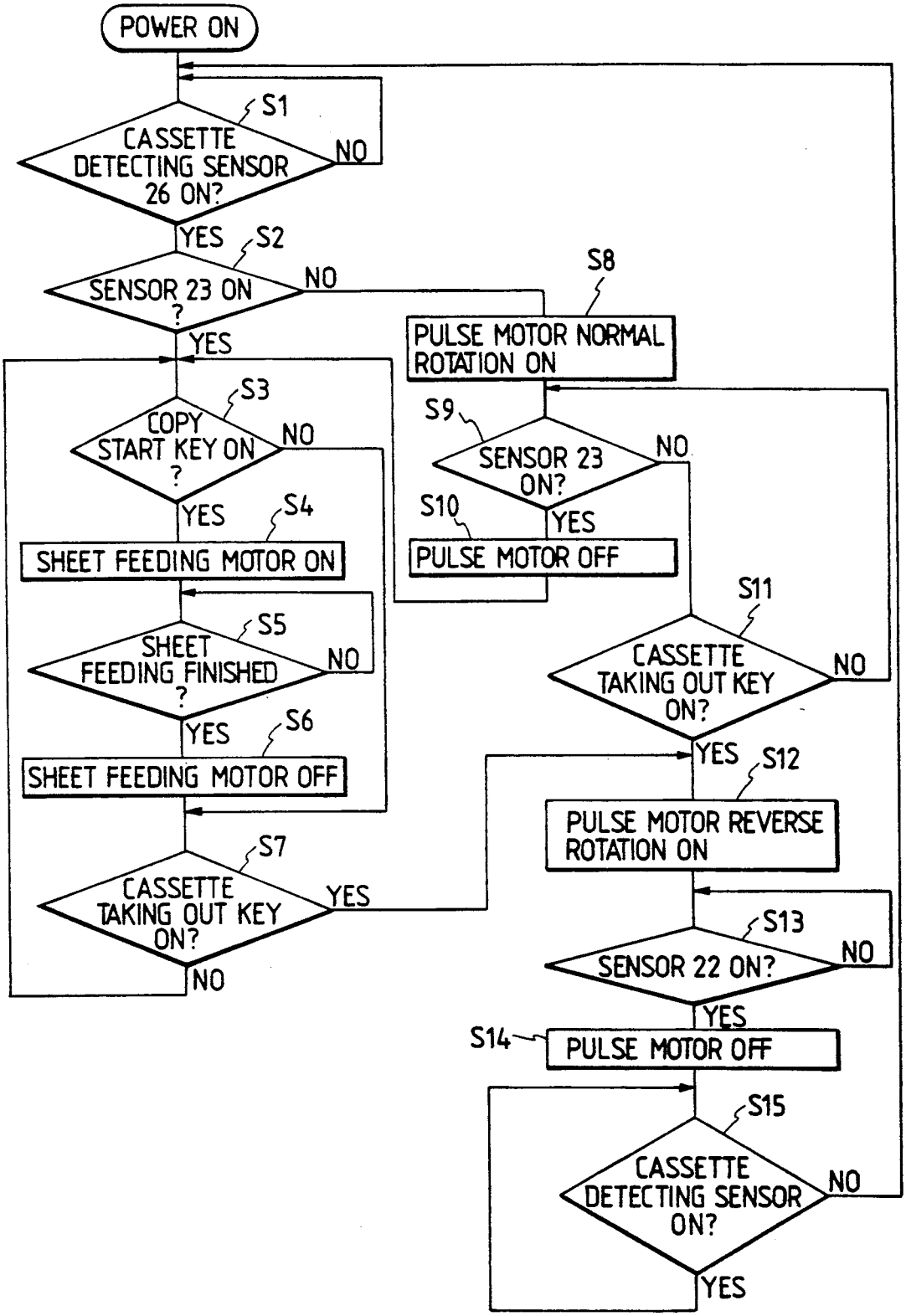
FIG. 9 is a flow chart for explaining the operation of the cassette loading device.

Next, an operation of the copying machine will be explained with reference to a flow chart of FIG. 9. When a power source is turned ON, the controlling portion (not seen in FIG. 9) judges whether the cassette detecting sensor 26 is turned ON or not (in a step S1); if yes, the controlling portion then judges whether the sensor 23 is turned ON or not (in a step S2). If it is judged that the sensor 23 is turned ON, the controlling portion then judges whether a copy start key (not shown) is turned ON or not (in a step S3); if yes, a sheet feed motor (not shown) is activated or turned ON (in a step S4). The activation of the sheet feed motor causes the feed rollers 6 to rotate, thereby feeding the sheet S from the cassette 3. Then, the toner image formed on the photosensitive drum 7 is transferred onto the sheet S, and then the image transferred on the sheet is fused or fixed to the sheet by means of a fixing device (not shown). Thereafter, the sheet is ejected from the machine frame 2.

After a predetermined number of sheets S are fed in the same manner, the controlling portion judges whether the sheet feeding is finished or not (in a step S5); if yes, the controlling portion turns the sheet feeding motor OFF, thereby stopping the sheet feeding operation (in a step S6). Further, the controlling portion judges whether a cassette taking-out key (not shown) is activated (turned ON) or not (in a step S7); if not, the controlling portion waits until the copy start key is turned ON.

On the other hand, in the step S2, if it is judged that the sensor 23 is not turned ON, the controlling portion drives the pulse motor 11 in the positive or normal direction to introduce the cassette 3 into the machine frame (in a step S8). The drive force from the motor 11 is transmitted to the sprocket 16 through the gears 12, 15 and is also transmitted to the sprocket 31 through the motor shaft 11*a* and the gears 27, 30. The rotation of the sprockets 16, 31 causes the chains 20, 35 to rotate, with the result that the pins 36 provided on the chains abut against the vertical surfaces 37*a* of the corresponding L-shaped recesses 37 formed in the cassette, thereby shifting the cassette 3 toward the interior of the machine frame in response to the rotational movement of the chains 20, 35. Then, the controlling portion judges whether the sensor 23 is turned ON or not (in a step S9); if yes, the pulse motor 11 is turned OFF (in a step S10). In this way, the cassette 3 is reached to the predetermined position in the machine frame 2 by means of the shifting device 5. Thereafter, the controlling portion executes the sequence from the above step S3 on.

On the other hand, in the step S9, if it is judged that the sensor 23 is not turned ON, the controlling portion judges whether the cassette taking-out key is turned ON or not (in a step S11); if not, the controlling portion then executes the sequence from the above step S9 on.

On the other hand, if it is judged that the cassette taking-out key is turned ON, the controlling portion rotates the pulse motor 11 in the reverse direction to shift the cassette 3 toward the outlet (in a step S12). The driving force from the pulse motor 11 is transmitted to the sprockets 16, 31 in the same manner as mentioned above, thus rotating the chains 20, 35 in the anticlockwise direction (FIG. 4) through the rotation of the sprockets. Consequently, the pins 36 of the chains abut against the vertical surfaces 37*b* of the corresponding L-shaped recesses 37, thus shifting the cassette 3 toward the outlet. Then, the controlling portion judges whether the sensor 22 is turned ON or not (in a step S13); if yes, the pulse motor 11 is turned OFF (in a step S14). Then, the controlling portion judges whether the cassette detecting sensor 26 is tuned ON or not (in a step S15); if not, the sequence from the above step S1 is repeated.

On the other hand, in the step S7, if it is judged that the cassette taking-out key is turned ON, the sequence from the above step S12 is executed.

Next, another embodiment of the present invention will be explained with reference to FIGS. 10 to 15.

Incidentally, it should be noted that the elements same as those explained in the previous embodiment are designated by the same reference numerals as used in the previous embodiment and the detailed explanation thereof will be omitted.

Figure 11:
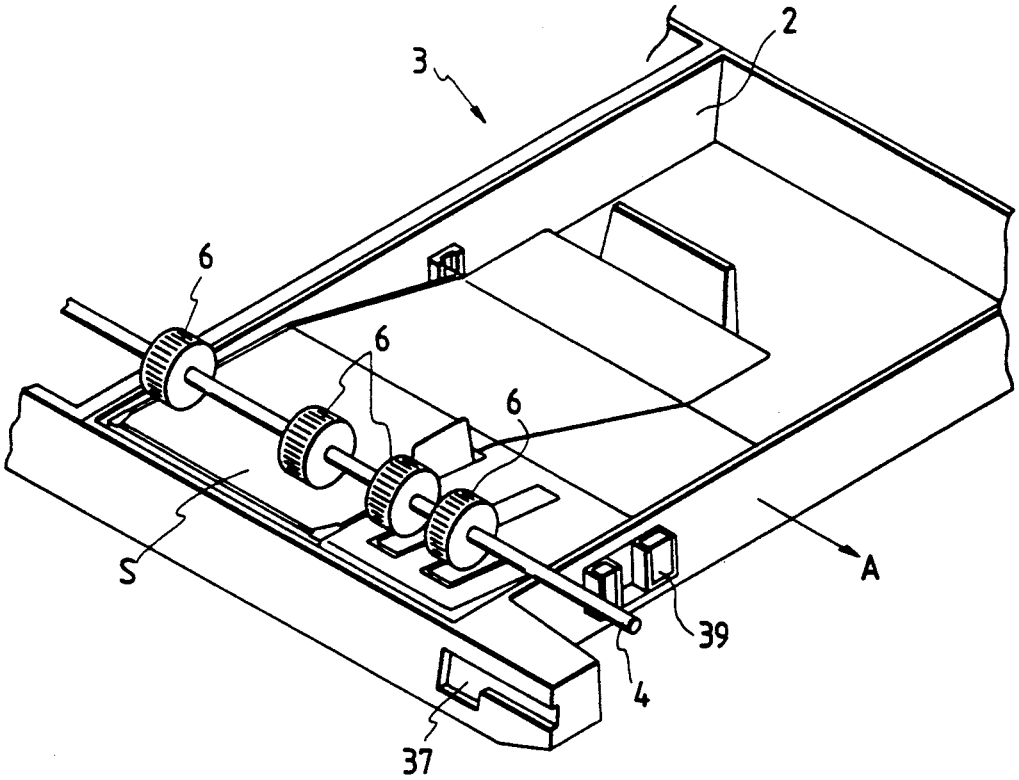
FIG. 11 is a perspective view of a sheet accommodating means used with the cassette loading device of FIG. 10.

As shown in FIG. 11, the cassette 3 used with the copying machine has a sheet size detecting block 39 removably mounted on a front surface (a forward surface with respect to the cassette inserting direction A) of the cassette. The block 39 serves to push one of sheet size detecting switches 40*a*, 40*b*, 40*c* arranged on the machine frame 2. Further, the block 39 can be changed to other block in accordance with the size of the sheets to be accommodated in the cassette.

Figure 12:
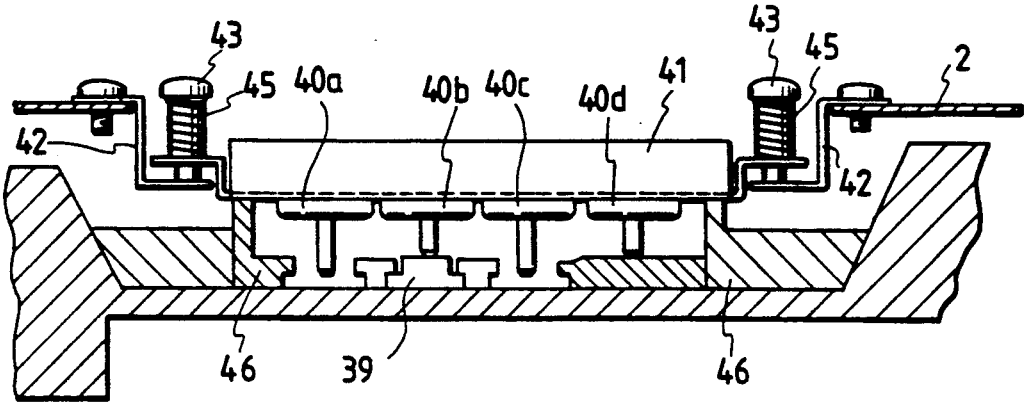
FIG. 12 is an elevational sectional view showing a detecting means.

Further, as shown in FIG. 12, an attachment plate 41 is provided on a portion of the machine frame 2 opposed to the block 39, which attachment plate 41 is slidably supported by pins each having an enlarged free end and protruded from a bracket 42 fixed to the machine frame 2. A compression spring 45 is arranged around each pin 43 between the enlarged end thereof and the attachment plate 41. The above-mentioned sheet size detecting switches 40*a*, 40*b*, 40*c* and a cassette existence detecting switch 40*d* are arranged on the attachment plate 41. Further, the cassette 3 has positioning spacers 46 for maintaining a predetermined distance between the attachment plate 41 and the cassette 3 itself, these spacers being situated outside of the switch group 40*a*–40*d*.

Figure 10:
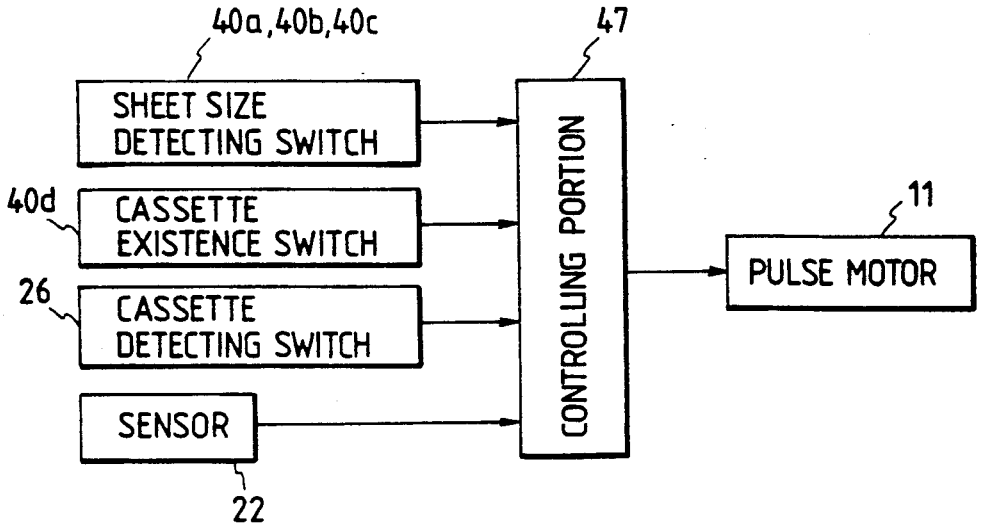
FIG. 10 is a block diagram showing a control means of a cassette loading device according to another embodiment of the present invention.

On the other hand, as shown in FIG. 10, the copying machine includes a controlling portion 47 having an input portion connected to the sheet size detecting switch 40*a*, 40*b*, 40*c*, cassette existence detecting switch 40*d*, sensor 22 and cassette detecting sensor 26, and an output portion connected to the pulse motor 11.

Figure 13:
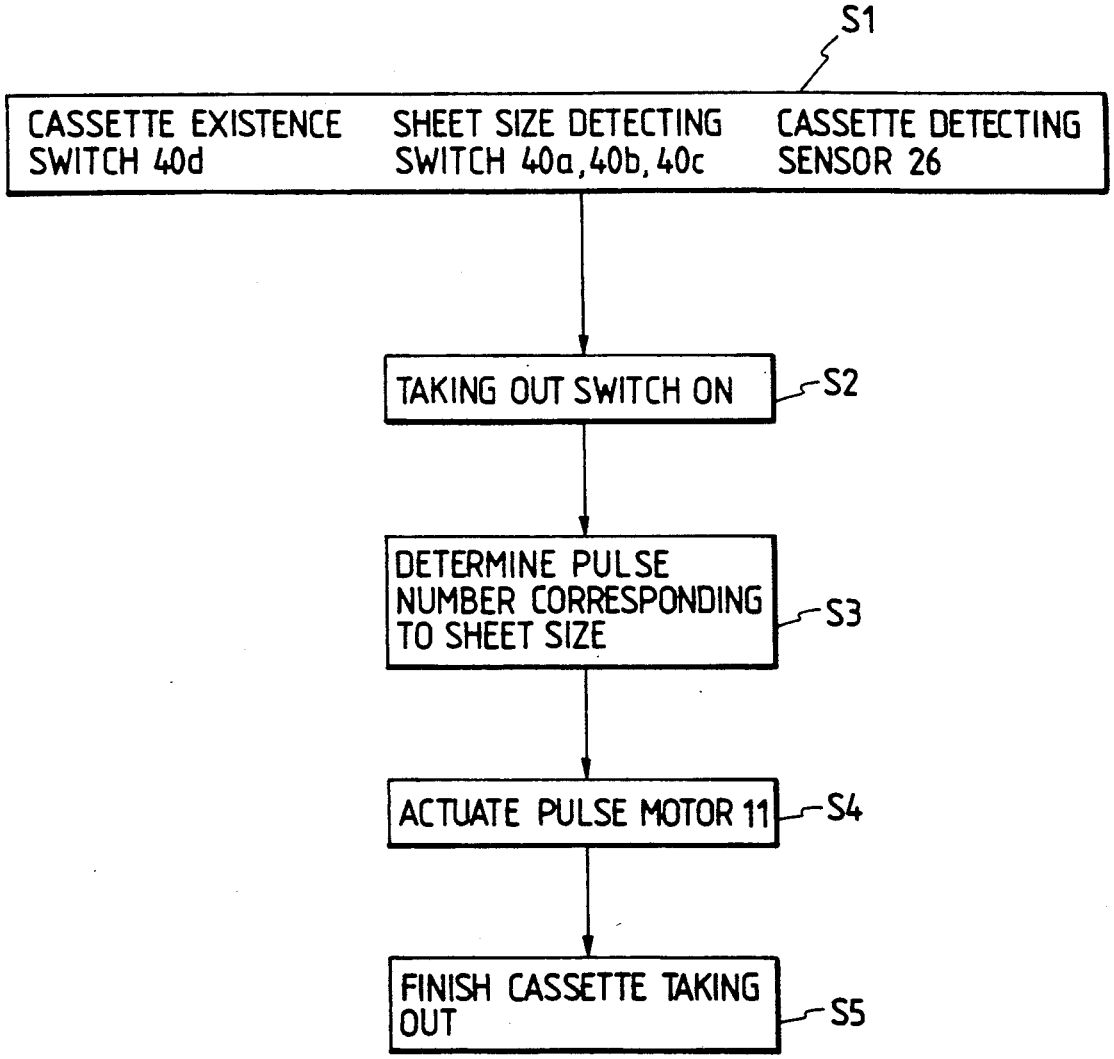
FIG. 13 is a flow chart for explaining the operation of the cassette loading device of FIGS. 10-12.
Figure 15:
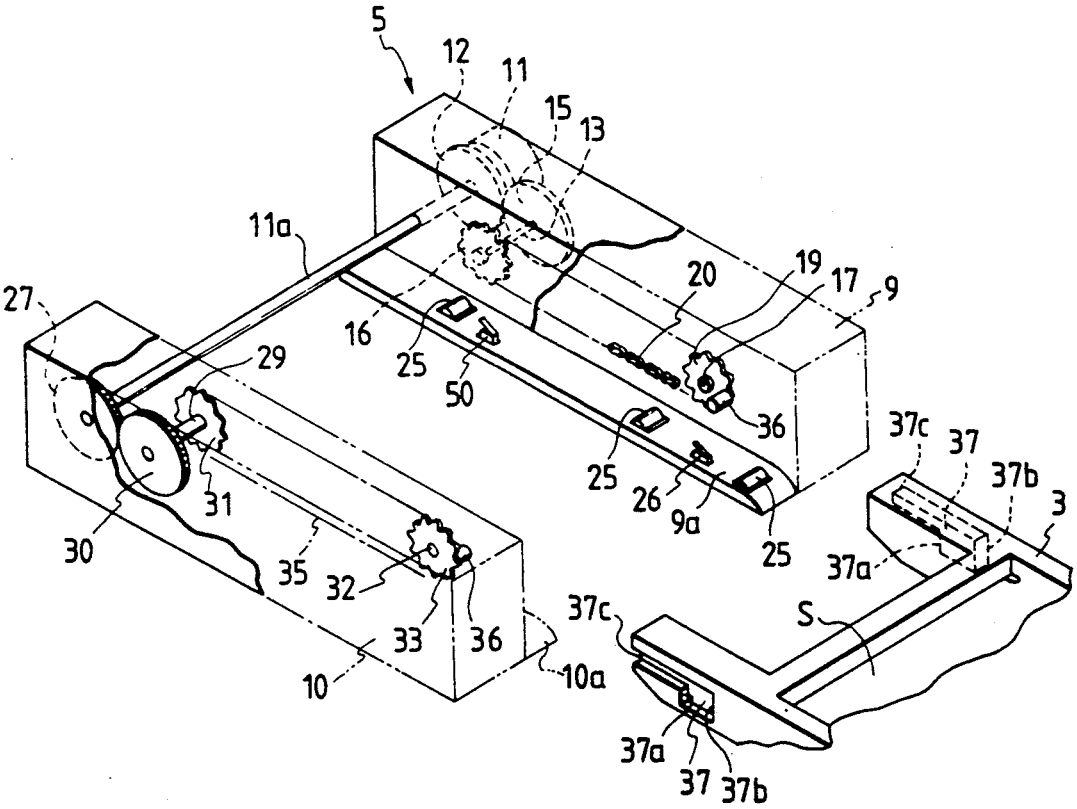

Next, the operation of the copying machine according to this embodiment will be explained with reference to a flow chart shown in FIG. 13.

In a condition that the cassette 3 is loaded on the copying machine, signals from the sheet size detecting switches 40*a*, 40*b*, 40*c*, cassette existence detecting switch 40*d*, sensor 22 and cassette detecting sensor 26 are being sent to the controlling portion 47. Accordingly, on the basis of these signals, the controlling portion confirms the face that the cassette exists within the machine and is positioned in the predetermined position and detects the sheet size (in a step S1).

When the taking-out switch (not shown) is turned ON (in a step S2), the controlling portion 47 receives an ON signal from the taking-out switch and determines the number of pulses corresponding to the sheet size (in a step S3), thereby actuating the pulse motor 11 by such number of pulses (in a step S4). Consequently, the sprockets 16, 31 are rotated in the direction E (refer to FIG. 3) to abut the pins 36 of the chains against the vertical surfaces 37*b* of the corresponding L-shaped recesses 37 formed in the cassette, thus shifting the cassette 3 toward the outlet (in the direction F in FIG. 3). After the pulse motor 11 is rotated by the predetermined pulses, the pulse motor 11 is stopped. In this point, the cassette 3 is retracted or protruded from the machine frame 2 by a distance corresponding to the sheet size. In this way, the taking-out of the cassette is finished (in a step S5).

On the other hand, when the cassette 3 accommodating the sheets S therein is inserted into the machine frame 2, since the pins 36 of the chains are aligned with the entrance openings 37*c* of the corresponding recesses 37, the pins 36 can be introduced into the corresponding recesses 37 by inserting the cassette 3 along the rail portions 9*a*, 10*a*. When the cassette turns the cassette detecting sensor 26 ON, the controlling portion receives the ON signal from the cassette detecting sensor 26, thereby actuating the pulse motor 11.

The driving force from the pulse motor 11 is transmitted to the sprocket 16 through the gears 12, 15 and is also transmitted to the sprocket 31 through the motor shaft 11*a* and the gears 27, 30. The rotation of the sprockets 16, 31 causes the chains 20, 35 to rotate, with the result that the pins 36 of the chains abut against the vertical surfaces 37*a* of the corresponding recesses 37 formed in the cassette, thereby shifting the cassette 3 toward the interior of the machine frame (in the direction D) (refer to FIG. 3) in response to the rotational movement of the chains 20, 35. Then, when the shield plate 21 turns the sensor 22 OFF, the controlling portion 47 receives the OFF signal from the sensor 22, thereby stopping the pulse motor 11. In this way, the cassette 3 is positioned in the predetermined position.

Figure 14A:
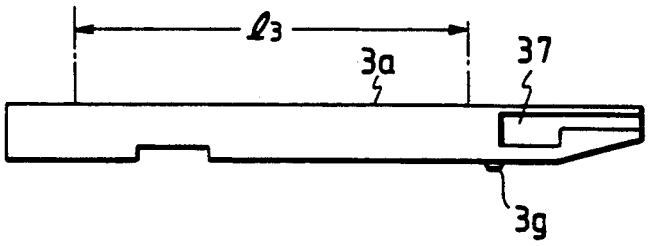
FIGS. 14A, 14B and 14C and FIG. 15 are views showing an alteration of the cassette loading device of FIGS. 10-12.
Figure 14B:
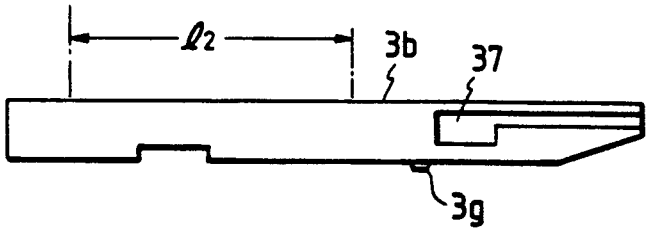
Figure 14C:
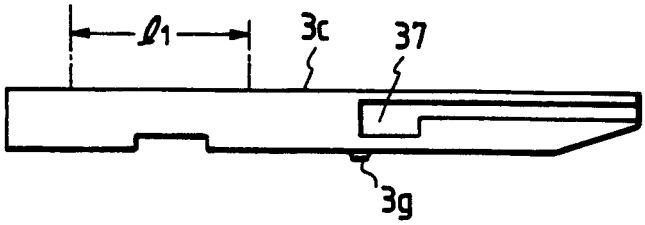

Incidentally, in the above-mentioned embodiment, while the cassette was illustrated as a cassette of universal type, but the present invention is not limited to the use of such cassette. For example, as shown in FIGS. 14A, 14B and 14C, different cassettes 3*a*, 3*b*, 3*c* may be prepared for sheets having different sizes. These cassettes 3*a*, 3*b*, 3*c* have L-shaped recesses 37 formed therein at different positions, respectively. The cassette 3*a* is used for receiving the sheets having large size, the cassette 3*b* is used for receiving the sheets having intermediate size, and the cassette 3*c* is used for receiving the sheets having small size.

Figure 8:
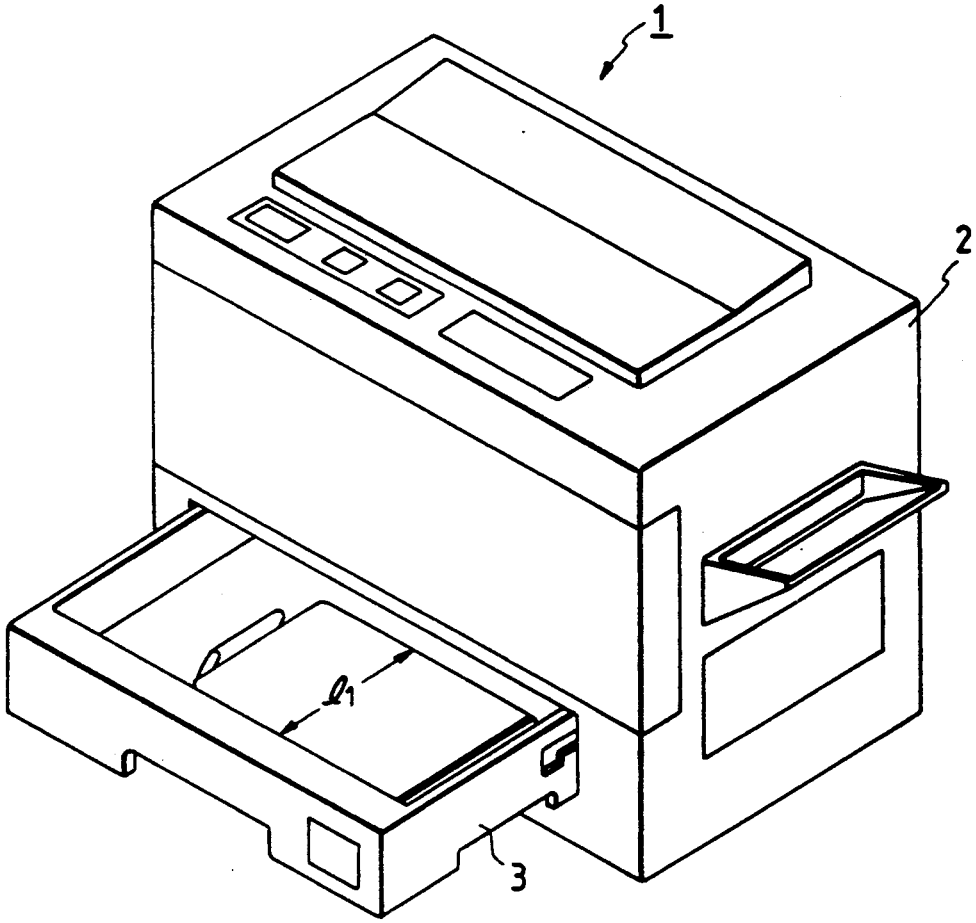
FIG. 8 is a perspective view of the image forming apparatus with a cassette retracted therefrom.

In case where such cassettes 3*a*, 3*b*, 3*c* are used, if a microswitch 50 is provided for detecting the fact that the cassettes 3*a*, 3*b*, 3*c* are positioned in the respective predetermined positions, the control regarding the sheet sizes by means of the controlling portion will be omitted. For example, when the cassette 3*c* corresponding to the sheet having the small size is loaded on the machine frame 2, as the cassette 3*c* is introduced into the machine frame until the pins 36 abut against the vertical surfaces 37*b* of the corresponding L-shaped recesses 37, a first projection 3*g* formed on the bottom surface of the cassette at a predetermined position turns the cassette detecting sensor 26 ON. Consequently, the cassette 3*c* is shifted toward the interior of the machine frame in the same manner as mentioned above. Then, when a second projection (not shown) formed on the cassette at a predetermined position turns the microswitch 50 ON, the pulse motor 11 is stopped, thus completing the loading of the cassette. Incidentally, as shown in FIGS. 14A to 14C, the first projection 3*g* is provided at a different position for each cassette 3*a*, 3*b*, 3*c*. On the other hand, when the cassette 3*c* is unloaded from the machine frame, the cassette is shifted toward the outlet in the same manner as mentioned above. Then, when the first projecting 3*g* is disengaged from the cassette detecting sensor 26, the pulse motor 11 is turned OFF. In this way, the cassette 3*c* is retracted up to a position where the sheets having the small size ($l_1$ in FIG. 8) can easily be replenished.

Figure 17A:
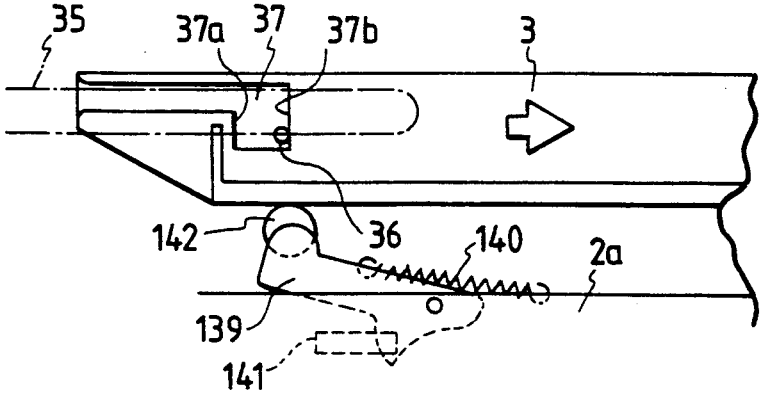
FIGS. 17A, 17B and 17C are side sectional views for explaining the operation of the second shifting means of FIGS. 16A-16C.
Figure 17B:
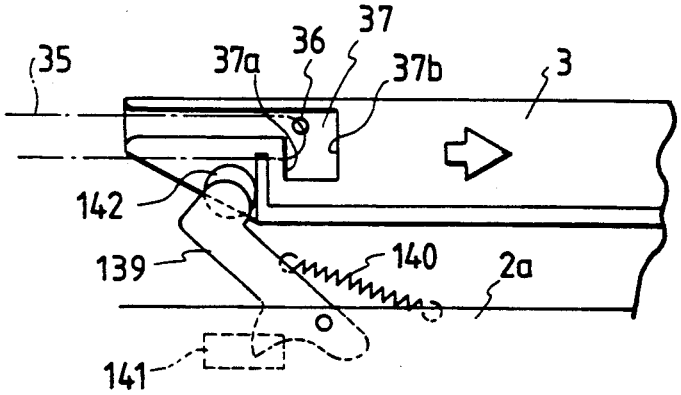
Figure 17C:
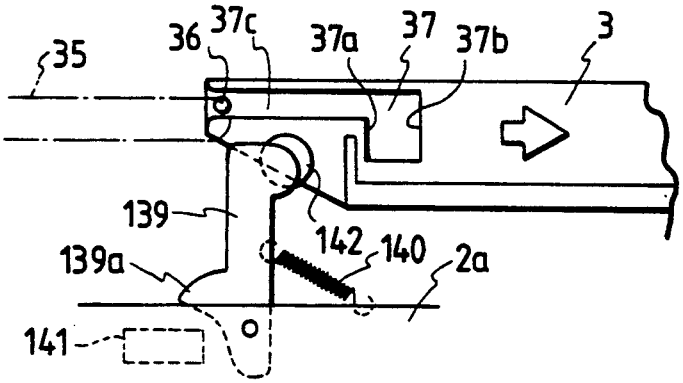
Figure 18:
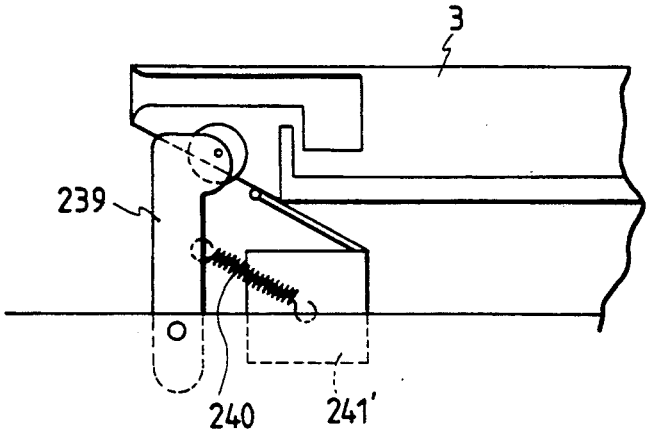
FIG. 18 is a side sectional view showing an alteration of the shifting means of FIGS. 16A-16C.

Next, a further embodiment of the present invention will be explained with reference to FIGS. 16–18.

Incidentally, it should be noted that the elements same as those explained in the previous embodiments are designated by the same reference numerals as used in such previous embodiments and the detailed explanation thereof will be omitted.

Figure 16A:
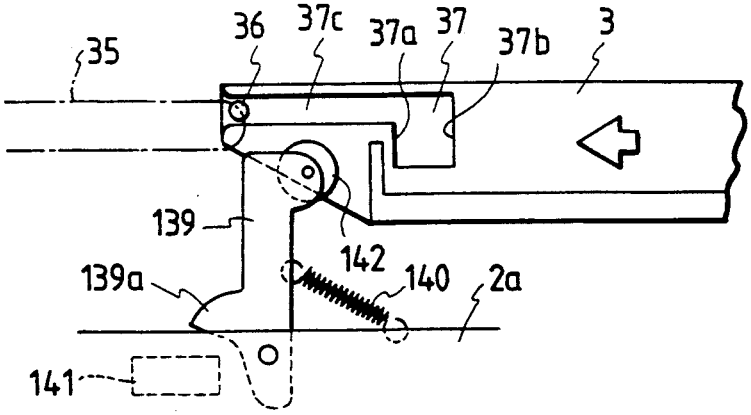
FIGS. 16A, 16B and 16C are side sectional views showing a second shifting means of a further embodiment according to the present invention.
Figure 16B:
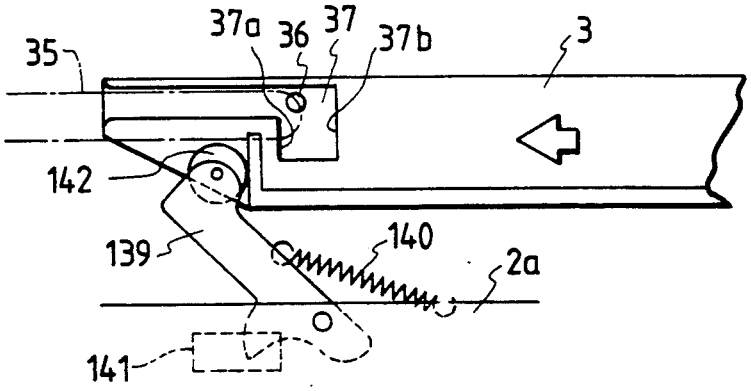
Figure 16C:
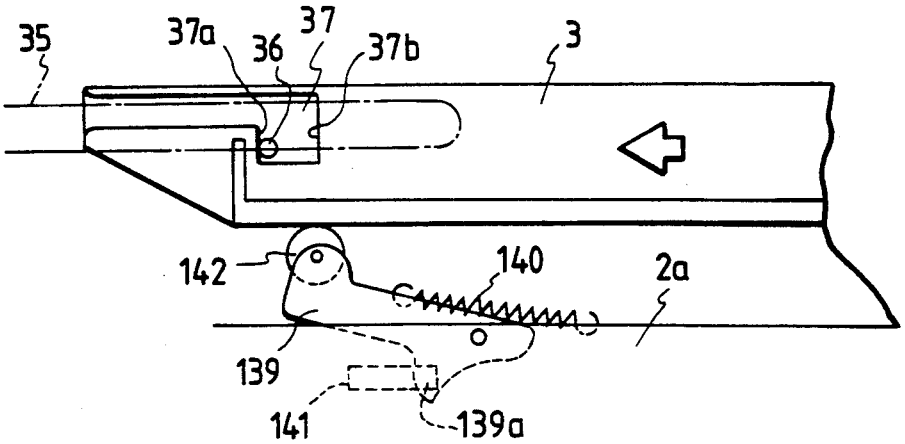

As shown in FIG. 16A, the copying machine includes an arm 139 rotatably supported by a machine frame 2*a*. An intermediate portion of the arm 139 is connected to one end of a bias spring 140, the other end of which is connected to the machine frame 2*a*. In this way, the arm 139 is normally held in a cocked or upright condition. Further, a cassette detecting sensor 141 is arranged in the vicinity of a base end of the arm 139, which sensor 141 is adapted to be activated or deactivated (ON or OFF) by means of a projection 139*a* of the arm 139. Further, a rotatable roller 142 is rotatably mounted on a free end of the arm 139.

In the illustrated embodiment, with the arrangement as mentioned above, when the cassette 3 is loaded on the machine frame 2*a*, since the pins 36 of the chains are aligned with the entrance openings 37*c* of the corresponding recesses 37, the pins 36 can be introduced into the corresponding recesses 37 by inserting the cassette 3 along the rail portions 9*a*, 10*a* (refer to FIG. 16A). As the cassette is further inserted, the arm 139 is rotated in an anti-clockwise direction in opposition to the bias force of the spring 140 in response to the movement of the cassette (refer to FIG. 16B). Then, when the roller 142 provided on the free end of the arm 139 abuts against the bottom surface of the cassette 3, the projection 139*a* of the arm 139 blocks an optical path between a light source and a light receiving portion of the cassette detecting sensor 141.

Then, by a signal from the sensor 141, the pulse motor 11 is rotated in the normal direction. The driving force from the motor 11 is transmitted to the chains 20, 35. In response to the rotational movement of the chains 20, 35 in the clockwise direction, the pins 36 are abutted against the vertical surfaces 37*a* of the corresponding recesses 37, thereby shifting the cassette 3 toward the interior of the machine frame (refer to FIG. 16C). Thereafter, the cassette 3 is shifted to the predetermined position and is positioned at that position in the same manner as previously mentioned.

On the other hand, when the cassette 3 is unloaded from the machine frame, as a taking-out button (not shown) is turned ON, the pulse motor 11 is rotated in the reverse direction in response to a signal from the taking-out button, thereby rotating the sprockets 16, 31 in the anti-clockwise direction. Consequently, the pins 36 of the chains are abutted against the vertical surfaces 37*b* of the corresponding L-shaped recesses 37 of the cassette, thus shifting the cassette 3 toward the outlet (refer to FIG. 17A). Then, when the cassette detecting sensor 141 is turned OFF, the pulse motor 11 is deactivated in response to an OFF signal from the sensor 141, thus finishing the shifting movement of the cassette 3 (refer to FIG. 17B). Then, the cassette 3 is further shifted toward the outlet through the rotation of the arm 139 caused by the bias force of the spring 140, whereby the projection 139*a* of the arm 139 is retarded from the optical path between the light source and the light receiving portion of the cassette detecting sensor 141, thus turning the sensor 141 ON (refer to FIG. 17C). In this way, the copying machine becomes a waiting condition for receiving the cassette 3, in response to the ON signal from the sensor 141.

Incidentally, in this embodiment, while an example that the cassette detecting sensor 141 which is turned ON and OFF by the projection 139*a* of the arm 139 is used as a detecting means was explained, the present invention is not limited to such example. For example, as shown in FIG. 18, a cassette detecting sensor 241' which can be turned ON and OFF by means of the cassette 3 itself. In this case, the arm 239 connected to the bias spring 240 has no projection.

Next, a still further embodiment of the present invention will be explained with reference to FIGS. 19 to 24.

Figure 19:
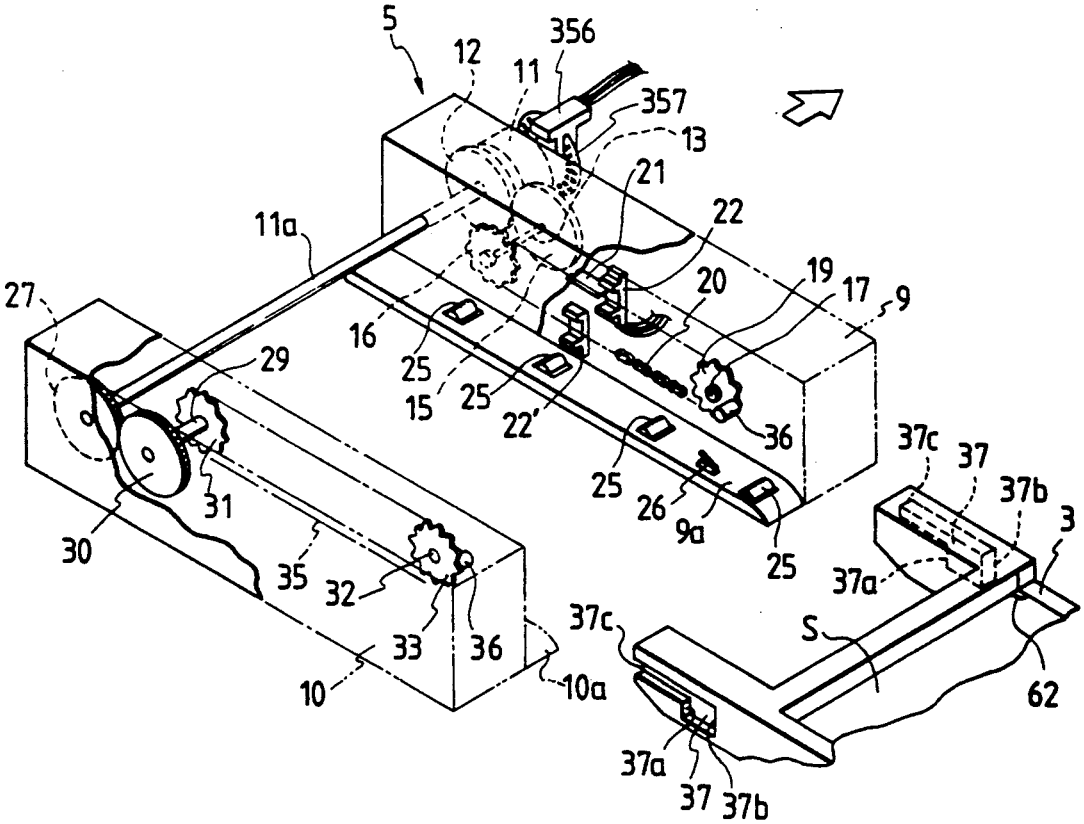
FIG. 19 is a perspective view of a cassette loading device according to a further embodiment of the present invention.

As shown in FIG. 19, a cassette shifting device 5 comprises frames 9 and 10, one of which (i.e., frame 9) includes a reversible motor 11 arranged therein. The motor 11 has a motor gear 11*a* on which a gear 12 is fixed, which gear 12 is meshed with a gear 15 fixed to a shaft 13 rotatably supported by the frame 9. A sprocket 16 is fixed to the other end of the shaft 13, which sprocket 16 is operatively connected, through a chain 20, to a sprocket 19 fixed to a shaft 17 rotatably supported by the frame 9. Further, a shield plate 21 is arranged on the chain 20, which shield plate 21 is adapted to turn ON and OFF (i.e., activate and deactivate) sensors 22 and 23 arranged in the vicinity of the chain 20.

The frame 9 has a rail portion 9*a* on which guide rollers 25 and a cassette detecting sensor 26 are arranged, whereas the frame 10 has a rail portion 10*a* on which guide rollers 25 are arranged. Further, a slitted disc 357 is fixed to one end of the motor shaft 11*a* of the motor 11, and a photo-interrupter 356 is arranged in the vicinity of the disc 357. The other end of the motor shaft 11*a* extends into the frame 10 and has a gear 27 fixed thereto. Further, the gear 27 is meshed with a gear 30 fixed to a shaft 29 rotatably supported by the frame 10. A sprocket 33 is fixed on the other end of the shaft 29, which sprocket is operatively connected, through a chain 35, to a sprocket 33 fixed to a shaft 32 rotatably supported by the frame 10.

The chains have pins 36 which can be moved together with the chains in response to the rotation of the chains 35, 20. Further, the cassette 3 is provided at its both front sides with laid L-shaped recesses 37 adapted to receive the pins 36 of the chains.

Figure 20:
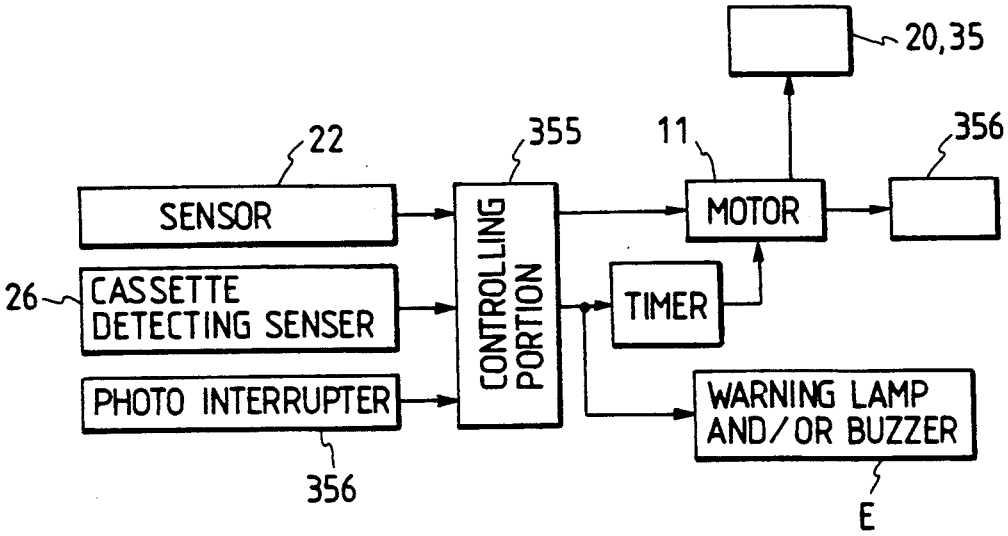
FIG. 20 is a block diagram showing a control means of the cassette loading device of FIG. 19.

As shown in FIG. 20, the copying machine 1 includes a controlling portion 355, to an input portion of which the sensors 22, 23, cassette detecting sensor 26 and the photo-interrupter 356 are connected; whereas the motor 11 is connected to an output portion of the controlling portion 355. Incidentally, the slitted disc 357 and the photo-interrupter 356 may be arranged at a position where these elements 356, 257 can sense the sprocket 19 or 16 which is subjected to a load initially when the abnormal condition occurs.

In the illustrated embodiment, with the arrangement as mentioned above, when the cassette 3 accommodating the sheets S therein is loaded within the machine frame 2, the pins 36 of the chains are positioned in a position where the pins face to entrance openings 37*c* (FIG. 4) of the corresponding L-shaped recesses 37. Accordingly, when the cassette 3 is inserted into the machine frame along the rail portions 9*a*, 10*a*, the pins 36 are introduced into the corresponding L-shaped recesses 37. Then, when the bottom surface of the cassette 3 turns the cassette detecting sensor 26 ON, the controlling portion 355 receives an ON signal from the sensor 26, thereby driving the motor 11. The driving force from the motor 11 is transmitted to the sprocket 16 through the gears 12, 15 and is also transmitted to the sprocket 31 through the motor shaft 11*a* and gears 27, 30. Subsequently, the chain 20 is rotated or turned through the rotation of the sprocket 16 and the chain 35 is turned through the rotation of the sprocket 35. As a result of the rotation of the chains 20, 35, the pins 36 abut against corresponding vertical surfaces 37*a* of the L-shaped recesses 37, thus shifting the cassette 3 toward the interior of the machine frame in response to the rotational movement of the chains 20, 35.

Figure 21:
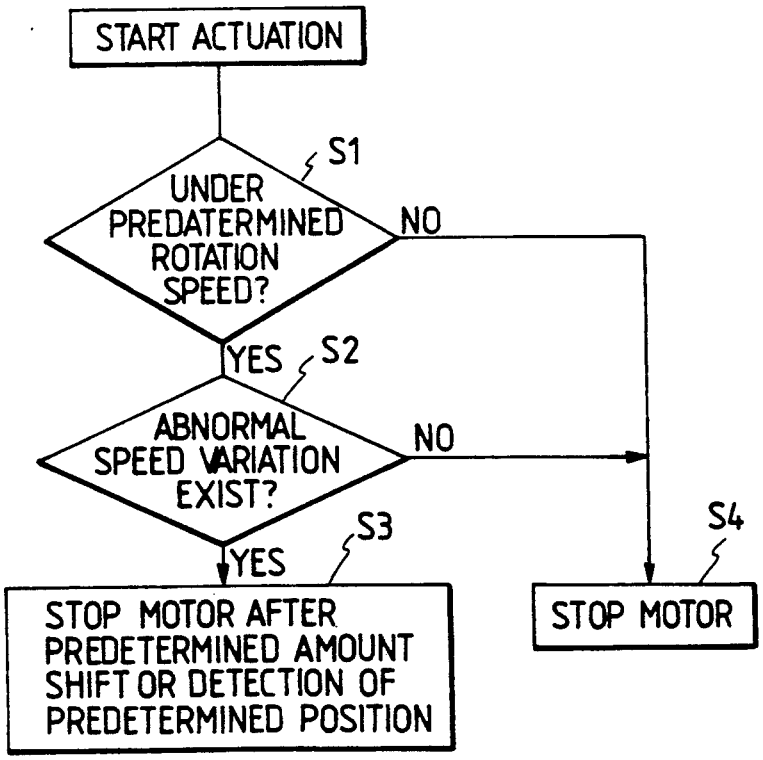
FIG. 21 is a flow chart for explaining the operation of the cassette loading device of FIGS. 19 and 20.
Figures 22A, 22B:
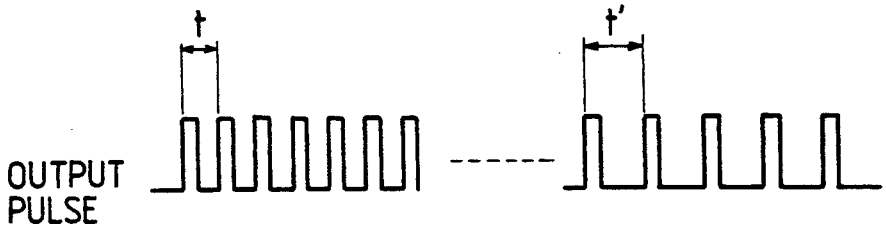
FIGS. 22A and 22B show pulse waves for the operation of the cassette loading device of FIG. 19.
Figure 23:
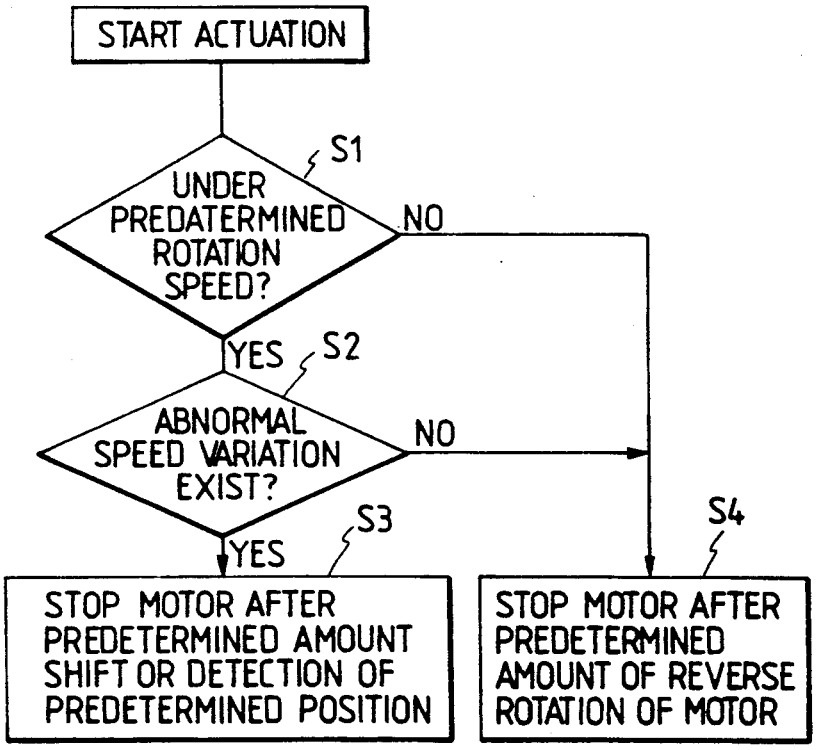
FIGS. 23 and 24 are flow charts according to alterations of the cassette loading device of FIG. 19.

In this case, the controlling portion 355 executes the sequence shown in a flow chart of FIG. 21.

The controlling portion 355 judges, on the basis of a signal from the photo-interrupter, whether the motor is rotated at a predetermined speed, i.e., whether output pulses from the photo-interrupter 356 is regularly emitted at the predetermined timing (t) (refer to FIG. 22A) (in a step S1); if yes, the controlling portion judges whether there exists abnormal speed variation of the motor (in a step S2). If it is judged that the abnormal speed variation does not exist, the controlling portion 355 continues to shift the cassette 3. When the shield plate 21 turns the sensor 22 OFF, the motor 11 is stopped (in a step S3). In this way, the cassette 3 is positioned at a predetermined position.

When a start key (not shown) is depressed after an original or manuscript is laid on a platen (not shown), an image on the original is read by an optical system (not shown) comprising a lamp, mirrors and lenses, thus forming a latent image on a photosensitive drum in an image forming portion (not shown). An uppermost sheet S is separated from the sheet stack accommodated in the cassette 3 by a separating pawl (not shown), and the uppermost sheet is fed out from the cassette by a feed roller (not shown). Then, the sheet S is fed to a pair of regist rollers (not shown) by means of a pair of feeding rollers (not shown) until the sheet S reaches the nip between the regist rollers. After the sheet abuts against the nip between the regist rollers, the sheet is subjected to the feeding force due to the feeding rollers with slipping action, thus correcting the skew-feeding of the sheet. Then, the sheet S is further fed in synchronous with the movement of the image on the photosensitive drum by means of the regist rollers rotating at the predetermined timing. Then, the image (toner image) on the photosensitive drum is transferred onto the sheet S. Thereafter, the sheet is fed to a fixing or fusing device (not shown) by means of feeding belts (not shown), where the transferred image is fixed to the sheet. Then, the sheet is ejected onto an ejector tray (not shown) by means of a pair of ejector rollers (not shown). Such a series of operations from the feeding of the sheet to the ejecting the sheet may be performed in a conventional manner.

Incidentally, in the above-mentioned step S1, if it is judged that the motor is not rotated at the predetermined speed, i.e., if it is judged that any load is applied to the motor at the beginning to prevent the regular emission of the output pulses of the photointerrupter 356 at the predetermined timing t (i.e., $t<t'$) (refer to FIG. 22B), the controlling portion 355 stops the motor 11 (in a step S4). Further, in the above-mentioned step S2, if it is judged that there exists the abnormal speed variation due to irregularity of the duration between the output pulses, i.e., if the excessive load is applied to the shifting device during the insertion of the cassette, the controlling portion 355 stops the motor 11 and at the same time emits an warning signal E to indicate the abnormity to an operator. Accordingly, the operator can eliminate the abnormity by removing the cassette from the copying machine manually.

Incidentally, in the illustrated embodiment, while an example that, if the motor is not rotated at the predetermined speed and/or if there exists the abnormal speed variation, the controlling portion 355 stops the motor 11 (or disengage any clutch between in the driving path to stop the chains without stopping the motor) was explained, the present invention is not limited to such example. For example, as shown in a flow chart of FIG. 23, if the above abnormal conditions occur, the motor 11 may be stopped after it is rotated at a predetermined amount in the reverse direction. With this arrangement, since the motor is stopped after the cassette is retarded from the abnormal condition, the damage of the cassette and/or copying machine can be prevented. Further, even if the operator's hand gets in between the cassette and the machine frame, he can easily draw out his hand by pulling the cassette toward the outlet.

Figure 24:
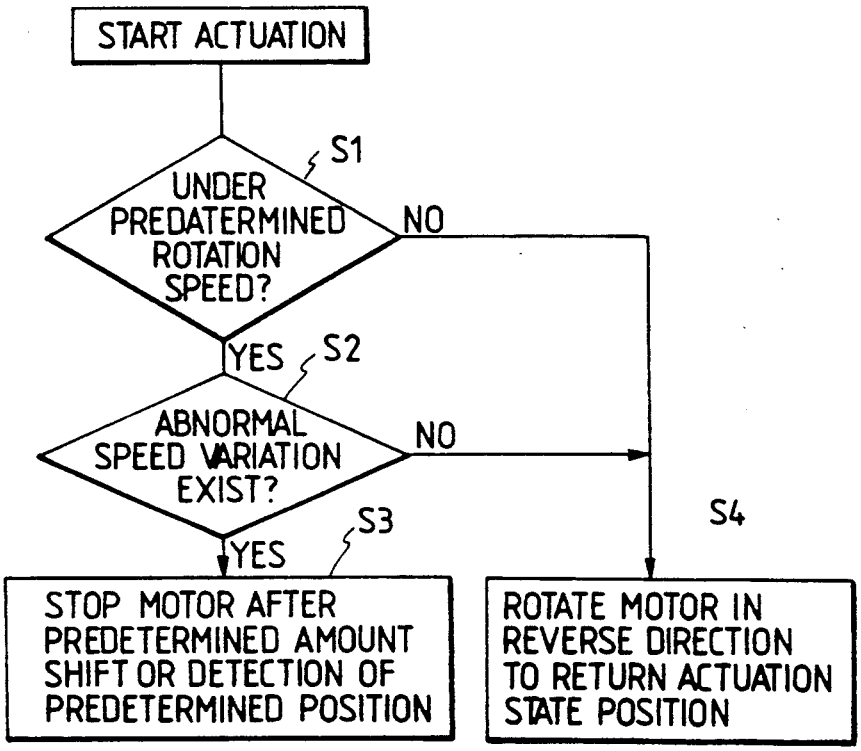

Alternatively, as shown in a flow chart of FIG. 24, the motor may be rotated in the reverse direction to return the cassette 3 to the actuation start position. In this case, the cassette can be retarded from the abnormal condition and such abnormal condition can be warned, and such abnormal condition can be corrected quickly.

Incidentally, the predetermined amount of reverse rotation of the motor can be performed by rotating the motor 11 in the reverse direction for a predetermined time through any timer circuit when any signal regarding the excessive load is emitted. On the other hand, the returning of the cassette to the actuation start position can be performed by returning the shield plate 21 to a position where it shields the sensor 22.

Further, in the illustrated embodiment, while an example that the slitted disc 357 and the photo-interrupter 356 are used as the detecting means to detect the rotational speed of the motor shaft 11*a* of the motor 11, thereby detecting the presence of the excessive load was explained, the present invention is not limited to such example. For example, a current detector for detecting a current value of the motor 11 may be used as the detecting means to detect the excessive load. In this case, when the current value exceeds a predetermined value, the controlling portion 355 confirms the fact that the excessive load occurs, thereby stopping the motor 11.

Further, after the abnormal condition is detected and then the cassette is returned by the predetermined amount or to the actuation start position, the detection of the abnormal condition may be reset. With this arrangement, if the operator's hand gets in between the cassette and the machine frame, after he draws out his hand, by pushing the cassette again, the cassette can automatically be re-loaded on the machine frame by means of the motor. Alternatively, the detection of the abnormal condition may be reset when the sensor 26 is turned OFF by withdrawing the cassette completely.

Incidentally, it is guessed that the excessive load is generated due to penetration of foreign matters in the cassette moving path, poor retraction of the sheet feeding means, mis-alignment between the cassette and the insertion position, insertion of the operator's hand between the cassette and the machine frame, error in loading of the sheets in the cassette, overload of the sheets in the cassette, or the like.

Figure 25A:
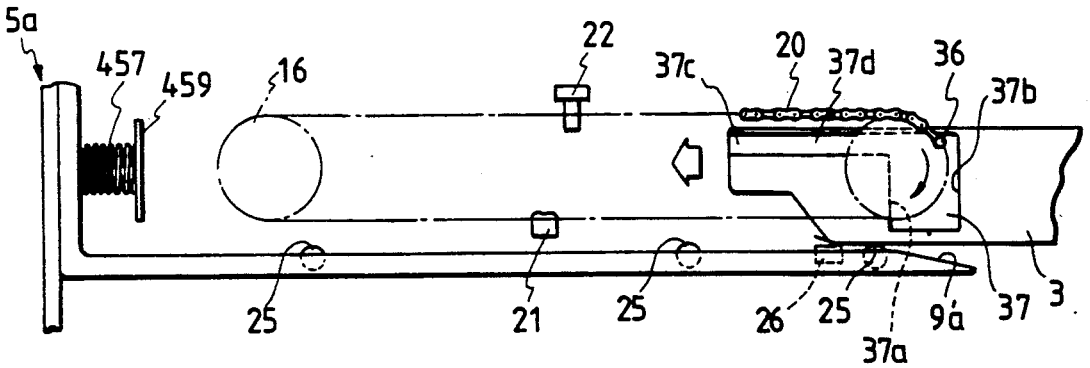
FIGS. 25A, 25B and 25C are side sectional views showing a further embodiment of a cassette loading device according to the present invention.
Figure 25B:
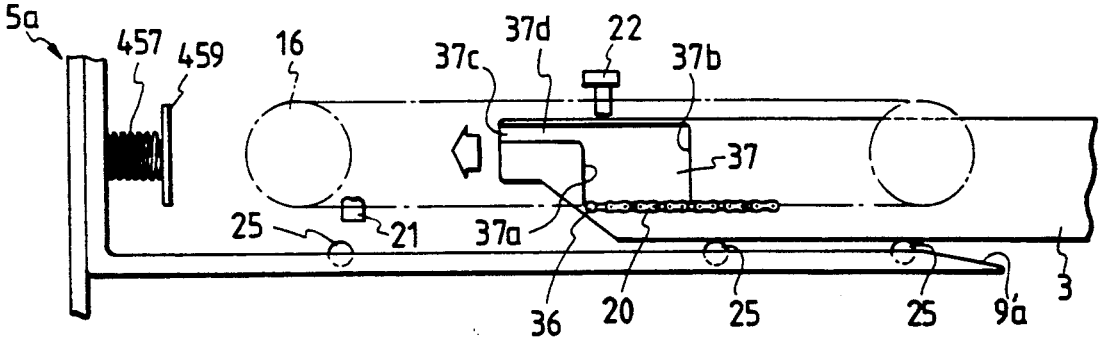
Figure 25C:
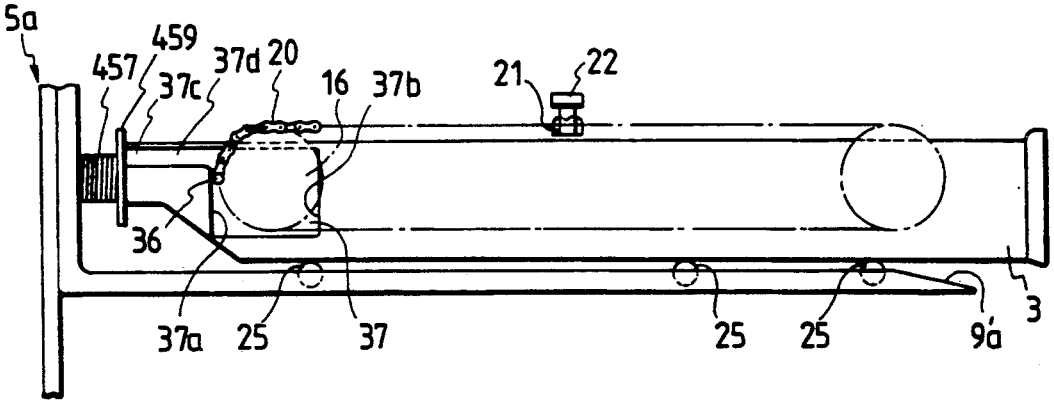

Next, a still further embodiment of the present invention will be explained with reference to FIGS. 25 and 26.

Incidentally, it should be noted that the elements same as those explained in the previous embodiments are designated by the same reference numerals as used in such previous embodiments and the detailed explanation thereof will be omitted.

Figure 26:
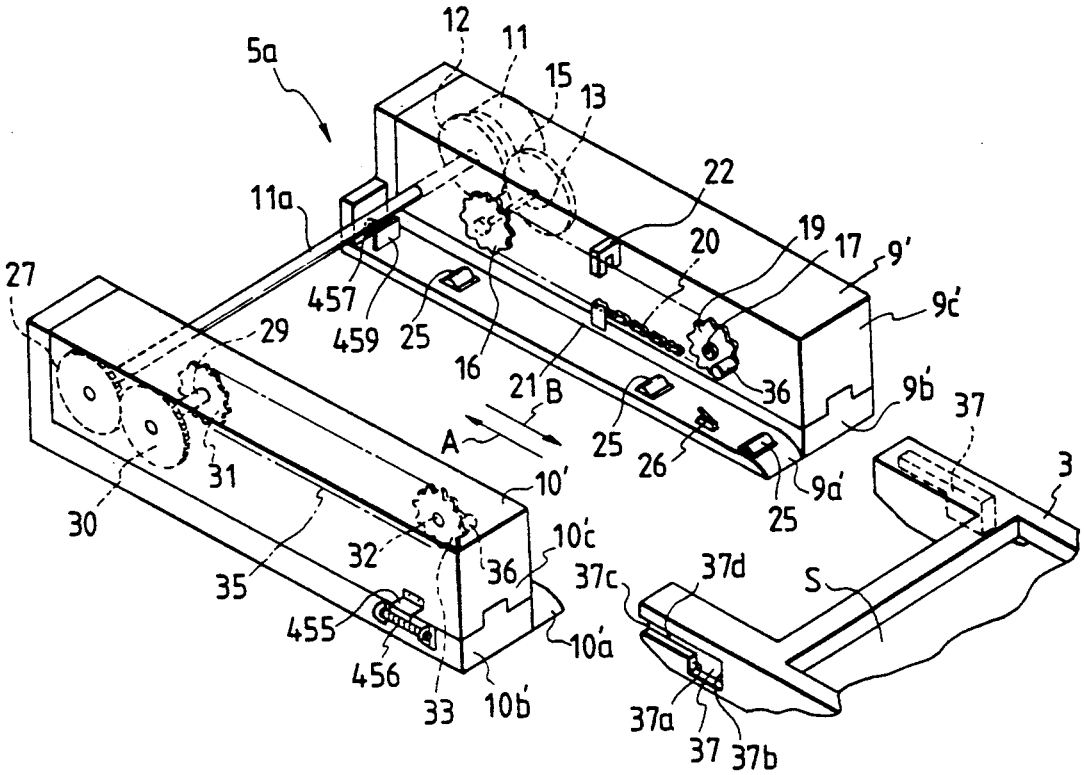
FIG. 26 is a perspective view of the cassette loading device of FIG. 25A-25C.

As shown in FIG. 26, a cassette shifting device 5*a* includes frames 9' and 10'. The frame 9' is constituted by a lower frame portion 9'*b* and an upper frame portion 9'*c* which can be slidably moved with respect to the Similarly, the frame 10' is constituted by a lower frame portion 10'*b* and an upper frame portion 10'*c* which can be slidably moved with respect to the lower frame portion 10'b in the directions A and B. Further, the upper frame portion 10'c has a rack 455 arranged thereon, and a screw 456 meshed with the rack 455 is fixedly mounted on the lower frame portion 10'b. Although not shown in the drawings, similarly, the upper frame portion 9'c and the lower frame portion 9'b of the frame 9' have a rack and a screw, respectively, which are meshed with each other. Further, the lower frame portion 9'b includes a rail portion 9'a having an inward upright end wall on which one end of a spring 457 is fixedly mounted. An abutment plate 459 is fixed to the other or free end of the spring 457, which abutment plate is adapted to abut against the cassette 3. Similarly, the lower frame portion 10'b includes a similar rail portion 10'a having a similar abutment plate.

In the illustrated embodiment, with the arrangement as mentioned above, when the cassette 3 accommodating the sheet S therein is loaded within the machine frame, since the pins 36 of the chains face to the entrance openings 37c of the corresponding L-shaped recesses of the cassette, as the cassette 3 is inserted into the machine frame along the rail portions 9'a, 10'a, the pins 36 can be introduced into the corresponding L-shaped recesses 37. Further, when the bottom surface of the cassette 3 is supported on the outermost guide roller 25, the pins 36 are aligned with the corresponding entrance openings 37c of the L-shaped recesses 37, and then, when the cassette 3 is shifted until the straight portions 37d of the L-shaped recesses 37 have passed through the corresponding pins 36, the cassette detecting sensor 26 is turned ON by the bottom surface of the cassette 3 (refer to FIG. 25A). Consequently, the controlling portion receives an ON signal from the sensor 26, thereby actuating the motor 11. The driving force from the motor 11 is transmitted to the sprocket 16 through the gears 12, 15 and is also transmitted to the sprocket 31 through the motor shaft 11a and the gears 27, 30.

Subsequently, the chain 20 is rotated in the clockwise direction through the rotation of the sprocket 16 and the chain 35 is also rotated through the rotation of the sprocket 31. As a result of the rotation of the chains 20, 35, the pins 36 are firstly moved along arcuate paths to abut against the corresponding vertical surfaces 37a of the L-shaped recesses 37, and, thereafter, the pins 36 are shifted along straight paths in response to further rotation of the chains 20, 35, thus shifting the cassette toward the interior of the machine frame (in the direction A) (refer to FIG. 25B). Accordingly, the cassette 3 is automatically shifted after it activates the cassette detecting sensor 26. As the cassette 3 is further shifted inwardly, an inward end wall of the cassette 3 abuts against the abutment plates 459, and thereafter, the cassette is further shifted inwardly while compressing the springs 457. Then, when the pins 36 reaches its innermost position on the chains (refer to FIG. 25C), the shield plate 21 turns the sensor 22 OFF. Incidentally, although the cassette is subjected to the returning force due to the compression of the springs 457, since the vertical surfaces 37a of the L-shaped recesses 37 of the cassette abut against the corresponding pins 36, the cassette is prevented from returning toward the outlet. Accordingly, the cassette is positioned correctly. Further, since the pins 36 of the chains are positioned symmetrically with respect to the upper and lower runs of the corresponding chains (see FIG. 25C), the returning force of the compressed springs does not act on the chains.

Incidentally, the position of the cassette 3 with respect to the machine frame 2 can be finely adjusted by rotating the screws 456 to move the racks 455 thereby shifting the upper frame positions 9'c, 10'c of the frames 9', 10' with respect to the lower frame portions 9'b, 10'b in the direction A or B.

In the illustrated embodiments, while the chains 20, 35 were used, the present invention is not limited to the use of such chains. For example, in place of the chains, V-shaped belts may be used. In this case, pulleys may be used in place of the sprockets 16, 19, 31 and 33.

Lastly, the other embodiment of the present invention will be explained with reference to FIGS. 27 to 34.

Figure 28:
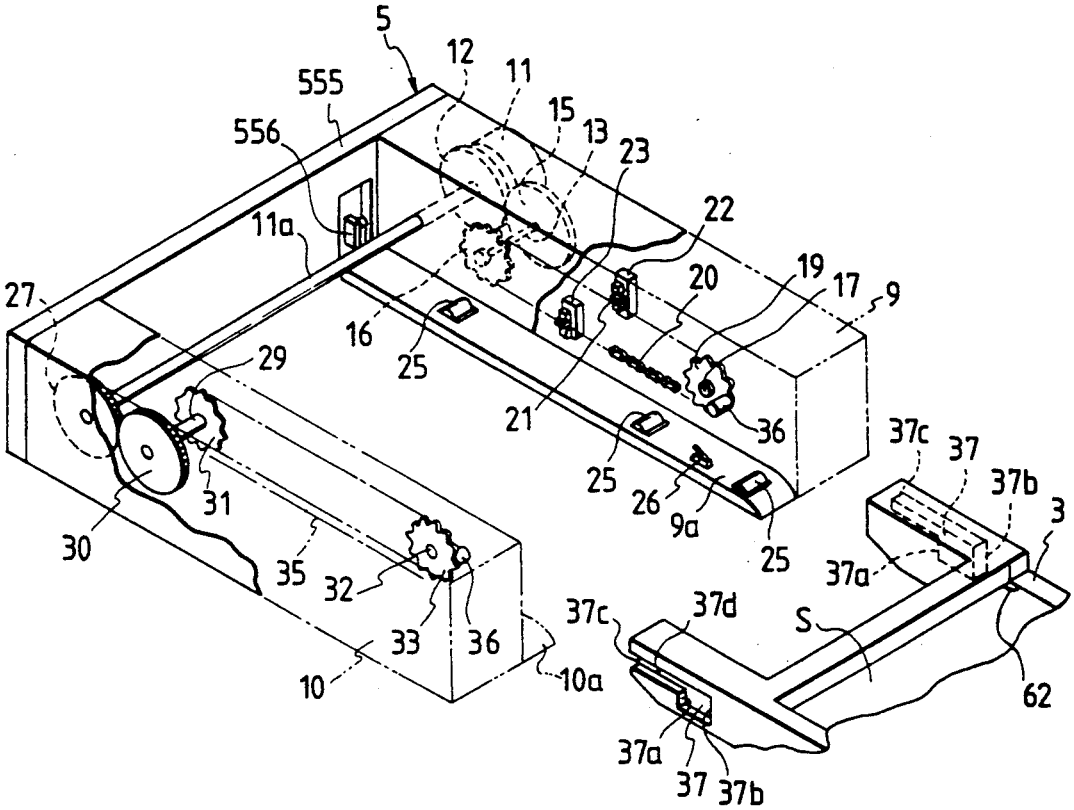
FIG. 28 is a perspective view of the cassette loading device of FIG. 27.

As shown in FIG. 28 the shifting device 5 comprises frames 9 and 10, one of which (i.e., frame 9) includes a reversible motor 11 arranged therein. The motor 11 has a motor shaft 11a on which a gear 12 is fixed, which gear 12 is meshed with a gear 15 fixed to a shaft 13 rotatably supported by the frame 9. On the other end of the shaft 13 a sprocket 16 is fixed, which sprocket is operatively connected, through a chain 20, to a sprocket 19 fixed to a shaft 17 rotatably supported by the frame 9.

Figure 2:
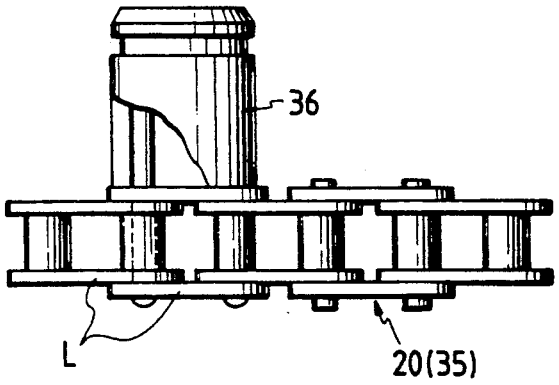
FIG. 2 is a plan view showing a detailed portion of the shifting means of FIG. 1.

A shield plate 21 is arranged on links L (refer to FIG. 2) of the chain 20, which shield plate 21 is adapted to turn ON or OFF (i.e., activate or deactivate) sensors 22 and 23 arranged in the vicinity of the chain 20. The frames 9, 10 have rail portions 9a, 10a, respectively, on which guide rollers 25 and a cassette detecting sensor 26 are arranged. Further, the motor shaft 11a of the motor 11 extends into the frame 10. On the free end of the shaft 11a a gear 27 is fixed. Further, the gear 27 is meshed with a gear 30 fixed to a shaft 29 rotatably supported by the frame 10. On the other end of the shaft 29 a sprocket 31 is fixed, which sprocket is operatively connected, through a chain 35, to a sprocket 33 fixed to a shaft 32 rotatably supported by the frame 10.

The chains 35, 20 have opposed pins 36 (refer to FIG. 2) which can be moved together with the chains in response to the rotation of the chains 35, 20. Further, the cassette 3 is provided at its both front sides with laid L-shaped recesses 37 adapted to receive the pins 36 of the chains. An abutment plate 555 against which the cassette can abut is fixed to inner ends of the frames 9 and 10. A cassette sensor 556 for detecting the fact that the cassette 3 reaches the sheet feeding position is arranged on the abutment plate 555. Incidentally, the reference numeral 62 designates a sheet separating pawl.

Figure 29:
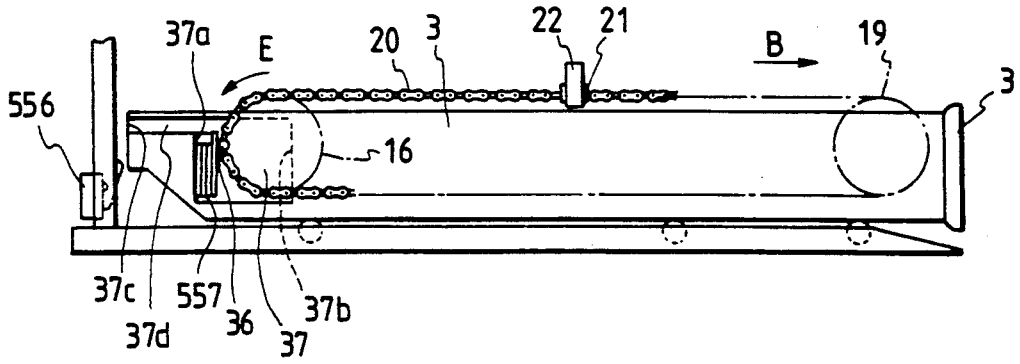
FIG. 29 is an elevational sectional view of the cassette loading device of FIG. 28.
Figure 30:
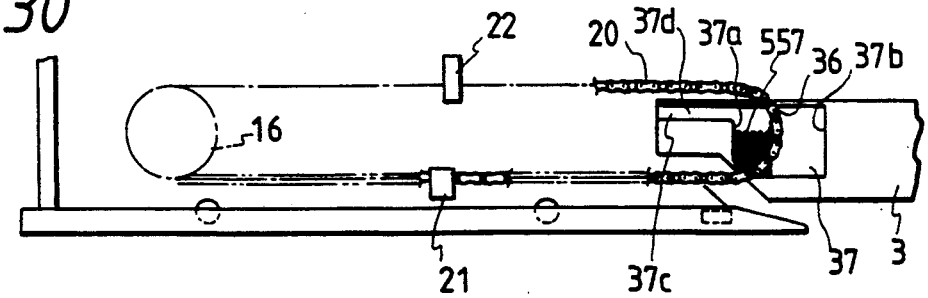
FIGS. 30 to 33 are side views of the device of FIG. 28 for explaining the operation thereof.
Figure 31:
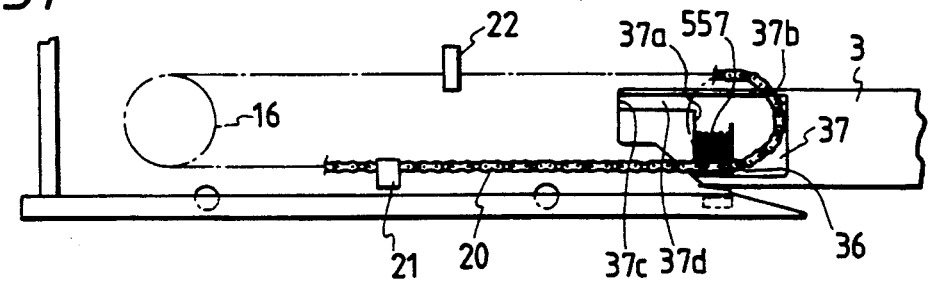

Further, as shown in FIG. 29, a spring 557 one end of which is fixed to the vertical surface 37a is arranged in each L-shaped recess 37 of the cassette. The springs 557 serve to compensate discrepancy in positions of the pins 36.

Figure 27:
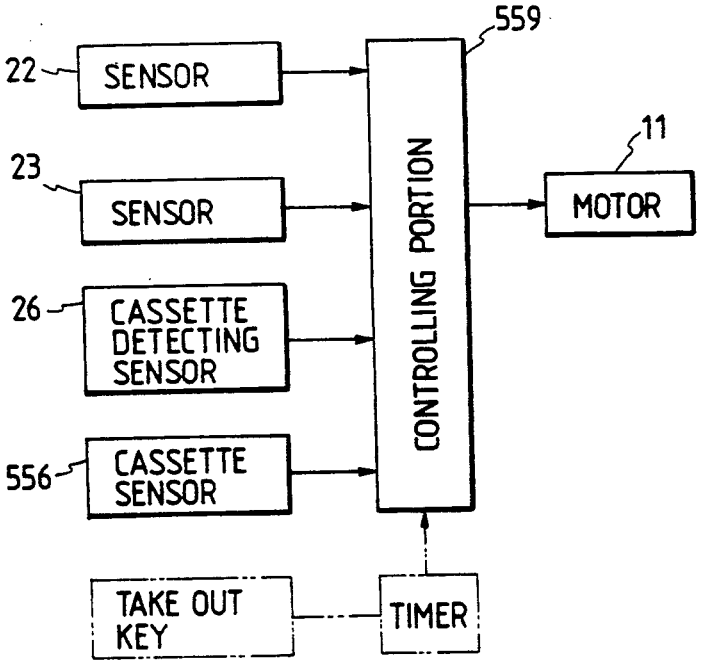
FIG. 27 is a block diagram of a cassette loading device according to the other embodiment of the present invention.

As shown in FIG. 27, the copying machine 1 includes a controlling portion 559, to an input portion of which the sensors 22, 23, cassette detecting sensor 26 and a cassette sensor 556 are connected; whereas the motor 11 is connected to an output portion of the controlling portion 559. Particularly, the sensor 23 acts as an outward home position sensor, and the sensor 22 acts as an inward home position sensor. ON or OFF signals from the sensors 26, 22, 23, 556 are sent to an microcomputer included in the controlling portion 559, and the controlling portion controls the normal or reverse rotation of the motor 11 properly on the basis of these signals.

In the illustrated embodiment, with the arrangement as mentioned above, when the cassette 3 accommodating the sheets S therein is loaded within the machine frame 2, the pins 36 are positioned in a position where they face to the entrance openings 37*c* (FIG. 30) of the L-shaped recesses 37 of the cassette and is positioned on the chain portion wrapping around the sprocket 19 (FIG. 28). This position of the pins 36 is always ensured by stopping the motor 11 at a predetermined time after the shield plate 21 is detected by the home position sensor 23.

On the other hand, each entrance opening 37*c* of the corresponding L-shaped recesses 37 of the cassette is formed in a position where, when the cassette 3 is situated on the rail portions 9*a* and 10*a*, the corresponding pin 36 can be smoothly inserted into the corresponding L-shaped recess 37. Accordingly, as the cassette 3 is inserted into the machine frame along the rail portions 9*a*, 10*a*, the pins 36 can be introduced into the corresponding recesses 37. When the bottom surface of the cassette 3 is supported on the outermost roller 25, the pins 36 are aligned with the corresponding entrance openings 37*a* of the L-shaped recesses, and then, when cassette 3 is shifted until straight portions 37*d* of the recesses 37 have passed through the corresponding pins 36, the cassette detecting sensor 26 is turned ON by the bottom surface of the cassette 3.

Consequently, the controlling portion 559 receives an ON signal from the sensor 26, thereby driving the motor 11. The driving force from the motor 11 is transmitted to the sprocket 16 through the gears 12, 15 and is also transmitted to the sprocket 31 through the motor shaft 11*a* and gears 27, 30.

Subsequently, the chain 20 is rotated in a clockwise direction through the rotation of the sprocket 16 and the chain 35 is rotated through the rotation of the sprocket 35. As a result of the rotation of the chains 20, 35, the pins 36 are firstly moved along arcuate paths to abut against the corresponding springs 557 attached to the vertical surfaces 37*a* of the L-shaped recesses 37 (refer to FIG. 28), and, thereafter, the pins 36 are shifted along straight paths in response to further rotation of the chains 20, 35, thus shifting the cassette 3 inwardly of the machine frame (in a direction A) (refer to FIG. 6). Accordingly, the cassette 3 is automatically inserted after it activates the cassette detecting sensor 26.

Figure 32:
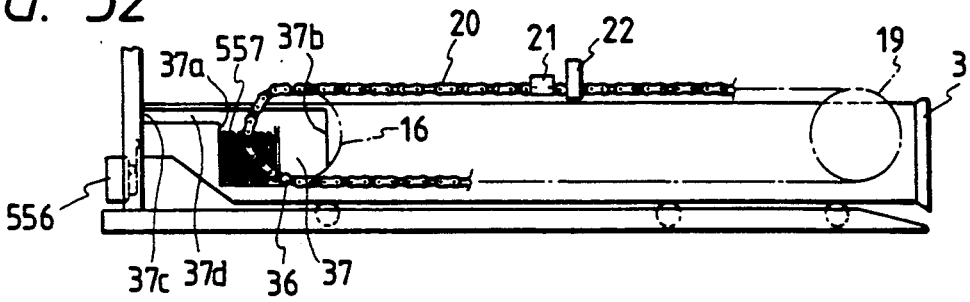
Figure 33:
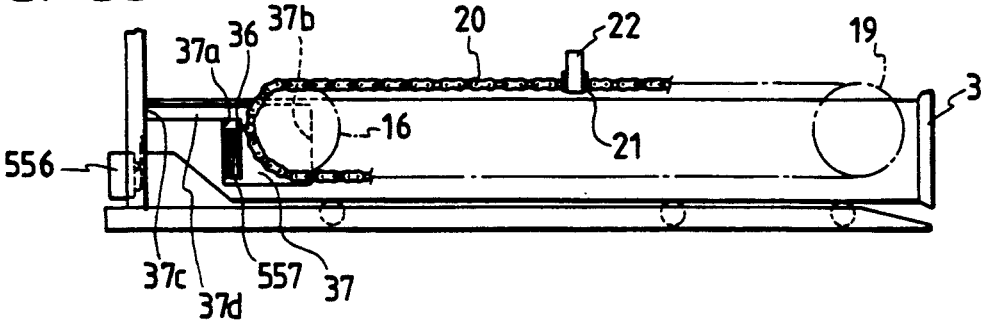

Further, as the cassette 3 is further shifted inwardly of the machine frame, the inward end wall of the cassette 3 abuts against the abutment plate 555 to turn the cassette sensor 556 ON (FIG. 32). In this point, the sensor 22 has not yet been turned OFF by the shield plate 21, and, therefore, the controlling portion 559 continues to rotate the motor 11. When the shield plate 21 turns the sensor 22 OFF (FIG. 33), the controlling portion 559 receives an OFF signal from the sensor 22, thereby stopping the motor 11. In this point, since the pins 36 of the chains compress the springs 557 and abut against the corresponding vertical surfaces 37*a* of the L-shaped recesses 37 with the interposition of the compressed springs, the cassette is positioned in a predetermined position (FIG. 5). Incidentally, it is more preferable that any braking means or locking means is provided in the motor or the gear train to maintain the cassette in the positioned condition.

On the other hand, when it is desired to unload the cassette 3, the operator slightly pulls the cassette outwardly (in the direction B) while further compressing the springs 557. Consequently, the inward end wall of the cassette 3 is separated to turn the cassette sensor 556 OFF. Then, the controlling portion 559 receives an OFF signal from the sensor 556, thereby deactivating the braking means or locking means, and at the same time, rotating the motor 11 in the reverse direction to rotate the sprockets 16, 31 in the direction E (FIG. 29). As a result, the pins 36 of the chains abut against the other vertical surface 37*b* (opposed to the above-mentioned vertical surfaces 37*a*) of the L-shaped recesses 37, thus shifting the cassette 3 toward the outlet (in the direction B). Thereafter, since the pins 36 of the chains are moved upwardly along the arcuate paths, the returning movement (toward the outlet) of the cassette 3 is stopped. Then, the pins 36 are moved to the position where the shield plate 21 turns the sensor 23 OFF, the controlling portion 559 receives the OFF signal from the sensor 23, thus stopping the motor 11 to thereby stop the movement of the chains 20, 35.

Figure 34:
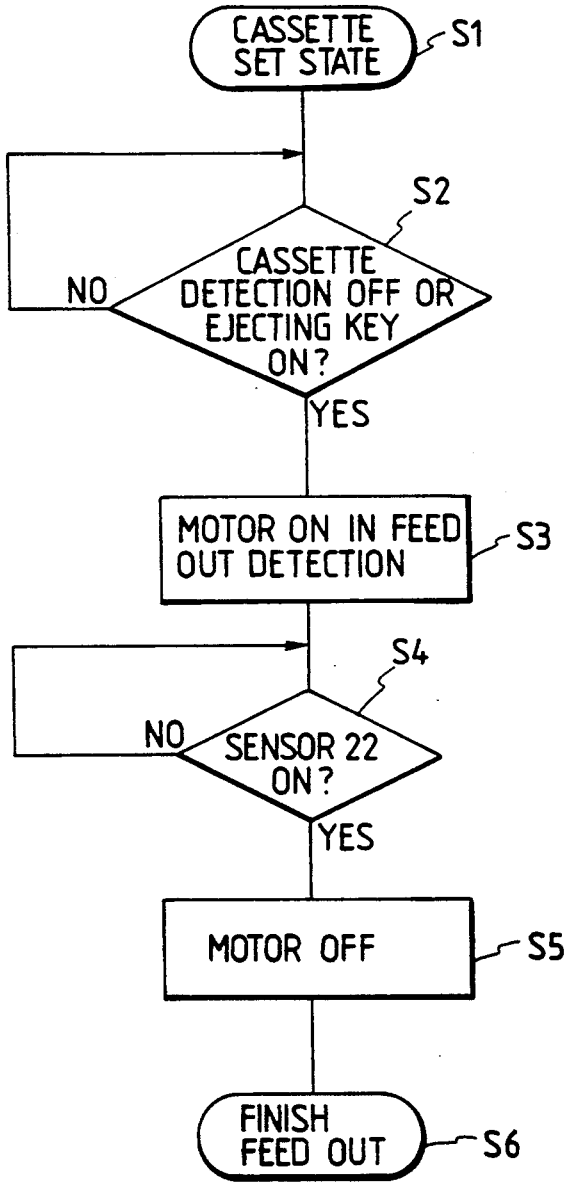
FIG. 34 is a flow chart associated with the cassette loading device of FIG. 28.

Next, the operation of the copying machine according to this embodiment will be explained with reference to a flow chart of FIG. 34. First of all, it is assumed that the cassette is set or loaded within the machine frame (step S1). In this condition, the cassette switch 556 is turned ON, sensor 23 is turned ON, sensor 22 is turned OFF, cassette detecting sensor is turned ON, and eject key is turned OFF, and motor 11 is turned OFF. For example, here, when the cassette is pulled outwardly, the controlling portion judges whether the cassette detecting sensor 26 is turned from ON to OFF (in a step S2); if yes, the controlling portion actuates the motor in the reverse direction, i.e., in the feed out direction (in a step S3). Consequently, the cassette is shifted toward the outlet. Meanwhile, when the sensor 23 is turned from ON to OFF, this fact is judged by the controlling portion (in a step S4), whereby the motor is turned OFF (in a step S5) to finish the feed-out of the cassette (in a step S6).

In this point, the braking means or locking means is activated again to hold the pins 36 in the stopped position. Since, in this point, the pins 36 are positioned in the straight portions 37*d* (FIG. 30) parallel to the entrance openings 37*c* and above the vertical surfaces 37*a* of the recesses 37, the cassette can easily be removed from the machine frame by pulling the cassette outwardly.

Incidentally, it may be so designed that the presence of the cassette 3 is detected by the cassette sensor 556 and is displayed on an operation panel. With this arrangement, the cassette sensor 556 can be utilized more effectively. Further, by constructing so that a timer is activated after a taking-out key is depressed, whereby the cassette taking-out movement is performed with a little delay, the operation of the taking-out key can be utilized together with the above operations.

While the present invention was explained in connection with various embodiments thereof, it should be noted that any combination of these embodiments can be adopted to the present invention.

We claim:

1. A cassette loading device for an image forming apparatus including a sheet feeding portion within which a cassette for accommodating sheets is loaded, and a sheet feeding means arranged in said sheet feeding portion and adapted to feed the sheet from said cassette loaded within said sheet feeding portion, comprising:

a guide means for guiding said cassette to be loaded;

a cassette shifting means having an engagement member engageable with said cassette inserted into said sheet feeding portion, and being comprised of a rotatable band-like member spanned along said guide means;

a driving means for driving said cassette shifting means;

engagement surface formed in said cassette and against which said engagement member is abutted to shift said cassette; and introduction passages formed in said cassette and adapted to direct said engagement member toward said engagement surfaces.

2. A cassette loading device according to claim 1, wherein said engagement surfaces comprise vertical surfaces formed in said cassette, and said introduction passages comprise horizontal recesses, said vertical surfaces and said horizontal recesses defining laid L-shaped recesses.

3. A cassette loading device according to claim 1, wherein said band-like member comprises chains spanned between a pair of sprockets, and said engagement member comprises pins arranged on the respective chains.

4. A cassette loading device according to claim 1, further including a detecting switch for cassette insertion arranged in a cassette shifting path, and wherein said switch is actuated when said cassette is inserted, thereby activating said driving means to shift said cassette.

5. A cassette loading device according to claim 1, further including a detecting switch for cassette return arranged in a cassette shifting path, and wherein said switch is actuated when said cassette is returned, thereby deactivating said driving means.

6. A cassette loading device according to claim 1, further including:

a sheet size detecting means; and a control means for controlling an amount of returning movement of said cassette by controlling said driving means on the basis of sheet size information from said sheet size detecting means.

7. A cassette loading device according to claim 1, further including:

a detecting means for detecting the fact that said cassette loaded within said sheet feeding portion is slightly retracted; and a control means for controlling said driving means in response to a signal from said detecting means to drive said cassette shifting means in a reverse direction.

8. A cassette loading device according to claim 1, further including:

a detecting means for detecting variation in load of said driving means; and a control means for stopping or reversing said driving means when it receives a load increase signal from said detecting means.

9. A cassette loading device according to claim 1, wherein said cassette shifting means comprises elliptical endless chains and said engagement member comprises pins provided on said chains, and wherein it further includes a control means for stopping said driving means when said pins are positioned at positions corresponding a position where said cassette is loaded within said sheet feeding portion.

10. A cassette loading device according to claim 1, further including an elastic returning means for returning said cassette shifting means by an elastic force after said cassette shifting means is returned by said driving means and is stopped.

11. A cassette loading device according to claim 1, wherein a sheet feeding direction is perpendicular to a cassette loading direction.

12. A cassette loading device according to claim 2, wherein said cassette shifting means comprises elliptical endless chains and said engagement member comprises pins provided on said chains, and wherein a home position of each of said pins is situated in a position where each of said pins is opposed to said respective horizontal recess, and further wherein said cassette has second vertical surfaces against which said pins are abutted to return said cassette.

13. A cassette loading device according to claim 1, wherein said band-like member is a V belt spanned between a pair of pulleys and said engagement member is a pin provided on the V belt.

14. An image forming apparatus including a sheet feeding portion within which a cassette for accommodating sheets is loaded, a sheet feeding means arranged in said sheet feeding portion and adapted to feed the sheet from said cassette loaded within said sheet feeding portion, and an image forming means for forming an image on the sheet being fed, comprising:

a guide means for guiding said cassette to be loaded:

a cassette shifting means having an engagement member engageable with said cassette inserted into said sheet feeding portion, and being comprised of a rotatable band-like member spanned along said guide means;

a driving means for driving said cassette shifting means;

engagement surface formed in said cassette and against which said engagement member is abutted to shift said cassette; and introduction passages formed in said cassette and adapted to direct said engagement member toward said engagement surfaces.

15. An image forming apparatus according to claim 14, wherein said band-like member is a chain spanned between a pair of sprockets and said engagement member is a pin provided on said chain.

16. An image forming apparatus according to claim 14, wherein said band-like member is a V belt spanned between a pair of pulleys and said engagement member is a pin provided on the V belt.

17. A cassette loading apparatus in an image forming device, comprising a sheet supplying portion into which a cassette for accommodating sheets in accumulated state is loaded, and feeding means provided on said sheet supplying portion for feeding the sheet member accommodated in the cassette loading in predetermined position of said sheet supplying portion, being characterized by:

first guiding means for guiding one end of the cassette;

second guiding means for guiding another end of the cassette;

first shifting means engaged with the cassette for shifting the cassette along said first guiding means; and second shifting means engaged with the cassette for shifting the cassette along said second guiding means.

18. A cassette loading apparatus according to claim 17, wherein each of said first and second shifting means has a pin for engaging with engagement surfaces formed on the cassette and is comprised of a rotatable band-like member spanned along said first and second guide means.

19. A cassette loading apparatus in an image forming apparatus, comprising a sheet supplying portion into which a cassette for accommodating sheets in accumulated state is loaded, and feeding means provided on said sheet supplying portion for feeding the sheet member accommodated in the cassette loaded in predetermined position of said sheet supplying portion, being characterized by:

guiding means for guiding loading of the cassette;

cassette shifting means for shifting the cassette to the predetermined position; and a resilient member for biasing the cassette at the predetermined position and in a direction opposite to the shifting direction of said cassette shifting means.

20. A cassette loading apparatus according to claim 19, wherein said cassette shifting means has a pin engaging with engagement surfaces formed on the cassette and is comprised of a rotatable band-like member spanned along guide means.

* * * * *